US005931143A

United States Patent [19]

Kitagawa et al.

[11] Patent Number: 5,931,143

[45] Date of Patent: Aug. 3, 1999

[54] AIR-FUEL RATIO CONTROL SYSTEM BASED ON ADAPTIVE CONTROL THEORY FOR INTERNAL COMBUSTION ENGINES

[75] Inventors: Hiroshi Kitagawa; Hidetaka Maki, both of Wako, Japan

[73] Assignee: Honda Giken Kogyo Kabushiki Kaisha, Tokyo, Japan

[21] Appl. No.: 09/089,038

[22] Filed: Jun. 2, 1998

Related U.S. Application Data

[62] Division of application No. 08/604,650, Feb. 21, 1996, Pat. No. 5,797,284.

[30] Foreign Application Priority Data

Feb. 24, 1995 [JP] Japan ..... 7-61778

[51] Int. Cl.[6] ..... F02D 41/14

[52] U.S. Cl. ..... 123/674; 123/694

[58] Field of Search ..... 123/694–696, 123/674, 675

[56] References Cited

U.S. PATENT DOCUMENTS

| | | | |
|---|---|---|---|
| 4,624,232 | 11/1986 | Saito et al. | 123/696 |
| 4,744,344 | 5/1988 | Morozumi | 123/479 |
| 5,179,929 | 1/1993 | Miyashita et al. | 123/688 |
| 5,433,185 | 7/1995 | Toyoda | 123/682 |
| 5,445,136 | 8/1995 | Yamashita et al. | 123/696 |
| 5,672,817 | 9/1997 | Sagisaka | 73/118.1 |

FOREIGN PATENT DOCUMENTS 3 185 244 8/1991 Japan .

OTHER PUBLICATIONS

"Comptrol", Computer and Application's Book, No. 27, Jul. 10, 1989, pp. 28–41.

"Automatic Control Handbook", Ohm, Ltd., Japan, pp. 703–707.

"A Survey of Model Reference Adaptive Techniques–Theory and Applications", Landau, Automatica, vol. 10, 1974, pp. 353–379.

"Unification of Discrete Time Explicit Model Reference Adaptive Control Designs", Landau et al. Automatica, vol. 17, No. 4, 1981, pp. 593–611.

"Combining Model Reference Adaptive Controllers and Stochastic Self–tuning Regulators", Landau, Automatica, vol. 18, No. 1, 1982, pp. 77–84.

*Primary Examiner*—Andrew M. Dolinar
*Assistant Examiner*—Arnold Castro
*Attorney, Agent, or Firm*—Nikaido Marmelstein Murray & Oram LLP

[57] ABSTRACT

An air-fuel ratio control system for an internal combustion includes an air-fuel ratio sensor arranged in the exhaust system, and an ECU which controls an amount of fuel to be supplied to the engine in a feedback manner based on an output from the air-fuel ratio sensor by using an adaptive controller of a recurrence formula type, such that the air-fuel ratio of an air-fuel mixture supplied to the engine becomes equal to a desired air-fuel ratio. Deterioration of a response characteristic of the air-fuel ratio sensor is detected based on at least one adaptive parameter used in the feedback control of the amount of fuel to be supplied to the engine.

6 Claims, 25 Drawing Sheets

*FIG.6A*
TDC
SIGNAL PULSE
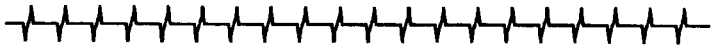
*FIG.6B*
A/F AT
CONFLUENT
PORTION
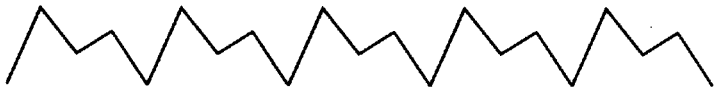
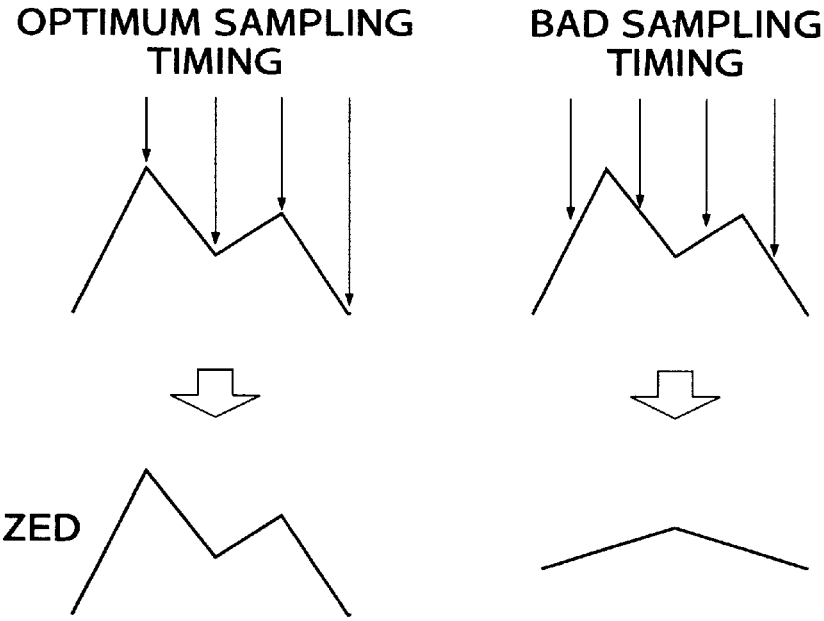
*FIG.7A*
ACTUAL A/F
*FIG.7B*
A/F RECOGNIZED
BY ECU KFB CALCULATION
S151
OPEN-LOOP IN LAST LOOP?
YES
NO
S152
DKCMD > DKCMDREF ?
YES
NO
S153
C=0
S154
C=C+1
S155
C≦CREF ?
YES
NO
S156
STR REGION DETERMINATION
S157
STR F/B REGION?
NO
YES
S158
FKSTR=0 IN LAST LOOP?
NO
YES
S159
KACT≧ KACTLMTL ?
YES
NO
S160
KACT≦ KACTLMTH ?
YES
NO
S161
KSTR CALCULATION
S162
| KSTR(k)−1.0 | >KSTRREF ?
YES
NO
S163
KFB=KSTR(k)
S164
KLAF CALCULATION
S165
KFB=KLAF(k)
RETURN

AIR-FUEL RATIO CONTROL SYSTEM BASED ON ADAPTIVE CONTROL THEORY FOR INTERNAL COMBUSTION ENGINES

This is a divisional of U.S. application Ser. No. 08/604, 650, filed Feb. 21, 1996, now U.S. Pat. No. 5,797,284.

BACKGROUND OF THE INVENTION

1. Field of the Invention

This invention relates to an air-fuel ratio control system for internal combustion engines, and more particularly to an air-fuel ratio control system of this kind, which controls the air-fuel ratio of an air-fuel mixture supplied to the engine in a feedback manner, by applying an adaptive control theory thereto.

2. Prior Art

There is conventionally known an air-fuel ratio control system for internal combustion engines, for example, from Japanese Laid-Open Patent Publication (Kokai) No. 3-185244, in which an optimal regulator which is one of modern control theories is applied to air-fuel ratio feedback control such that the air-fuel ratio is feedback-controlled based on an output from a linear-output oxygen concentration sensor (LAF sensor) arranged in the exhaust system of the engine, and an optimum feedback gain and state variables which have been set based on a dynamic model representative of the behavior of the engine.

According to the above conventional air-fuel ratio control system, however, no contemplation is made of deterioration of the response characteristic of the air-fuel ratio sensor due to aging or the like, and therefore, when the sensor has become deteriorated to a degree exceeding a degree expected when it was originally designed, an ineffective time (dead time) of the dynamic model representative of the behavior of the engine changes to an unnegligible degree. As a result the controllability of the air-fuel ratio can be extremely degraded.

Further, according to the above conventional air-fuel ratio control system, the optimum feedback gain set based on the dynamic model representative of the behavior of the engine is employed, and therefore, when the response characteristic of the air-fuel ratio sensor and/or other factors which cause changes in the dynamic model representative of the behavior of the engine are deteriorated, the optimum feedback gain can have an inappropriate value to proper feedback control of the air-fuel ratio to be carried out.

SUMMARY OF THE INVENTION

It is a first object of the invention to provide an air-fuel ratio control system for an internal combustion engine, which is capable of detecting deterioration of the response characteristic of an air-fuel ratio sensor in a simple manner.

It is a second object of the invention to provide an air-fuel ratio control system for an internal combustion engine, which is capable of minimizing the degree of degradation of the controllability of the air-fuel ratio even if the response characteristic of the air-fuel ratio sensor is deteriorated, to thereby maintain good controllability of the air-fuel ratio for a long time period.

To attain the first object, the present invention provides an air-fuel ratio control system for an internal combustion engine having an exhaust system, comprising:

an air-fuel ratio sensor arranged in the exhaust system;

feedback control means for controlling an amount of fuel to be supplied to the engine in a feedback manner based on an output from the air-fuel ratio sensor by using an adaptive controller of a recurrence formula type, such that an air-fuel ratio of an air-fuel mixture supplied to the engine becomes equal to a desired air-fuel ratio; and response characteristic deterioration-detecting means for detecting deterioration of a response characteristic of the air-fuel ratio sensor, based on at least one adaptive parameter used by the feedback control means.

Preferably, the adaptive controller includes a self-tuning regulator controller for setting an adaptive control correction coefficient (KSTR) based on a plurality of adaptive parameters ($\hat{\theta}(k)$) including the at least one adaptive parameter (r1, r2) by using a recurrence formula, such that the air-fuel ratio of the air-fuel mixture supplied to the engine becomes equal to the desired air-fuel ratio, and a parameter adjusting mechanism for setting the plurality of the adaptive parameters by using a recurrence formula, the at least one adaptive parameter (r1, r2) determining responsiveness of the parameter adjusting mechanism.

More preferably, the feedback control means calculates the amount (TOUT)of fuel to be supplied to the engine by multiplying a basic fuel amount (TIMF) set according to operating conditions of the engine, by a plurality of correction coefficients including a desired air-fuel ratio correction coefficient (KCMDM) set according to operating conditions of the engine and the adaptive control correction coefficient (KSTR) set according to an output from the air-fuel ratio sensor by the self-tuning regulator controller.

Alternatively, the response characteristic deterioration-detecting means detects the deterioration of the response characteristic of the air-fuel ratio sensor, based on a change characteristic of the output from the air-fuel ratio sensor assumed immediately after interruption of supply of fuel to the engine.

To attain the second object, the present invention provides an air-fuel ratio control system for an internal combustion engine having an exhaust system, comprising:

an air-fuel ratio sensor arranged in the exhaust system;

feedback control means for controlling an amount of fuel to be supplied to the engine in a feedback manner based on an output from the air-fuel ratio sensor by using an adaptive controller of a recurrence formula type, such that an air-fuel ratio of an air-fuel mixture supplied to the engine becomes equal to a desired air-fuel ratio;

response characteristic deterioration-detecting means for detecting deterioration of a response characteristic of the air-fuel ratio sensor; and adjusting speed-lowering means responsive to detection of the deterioration of the response characteristic of the air-fuel ratio sensor by the response characteristic deterioration-detecting means, for lowering adjusting speed of adaptive parameters used by the adaptive controller of the feedback control means.

Preferably, the adaptive controller includes a self-tuning regulator controller for setting an adaptive control correction coefficient (KSTR) based on a plurality of adaptive parameters ($\hat{\theta}(k)$) by using a recurrence formula, such that the air-fuel ratio of the air-fuel mixture supplied to the engine becomes equal to the desired air-fuel ratio, and a parameter adjusting mechanism for setting the plurality of the adaptive parameters by using a recurrence formula.

More preferably, the adjusting-speed lowering means changes a gain ($\Gamma$) determining a changing speed of the plurality of the adaptive parameters ($\hat{\theta}(k)$) to a smaller value.

Alternatively, to attain the second object, the air-fuel ratio control system according to the invention may include delaying means responsive to detection of the deterioration of the response characteristic of the air-fuel ratio sensor by the response characteristic deterioration-detecting means, for delaying timing of the calculation of the feedback control amount by the feedback control means.

Preferably, the adaptive controller includes adaptive control means for calculating an adaptive control correction coefficient (KSTR), based on a plurality of adaptive parameters ($\hat{\theta}(k)$) by using a recurrence formula, such that the air-fuel ratio of the air-fuel mixture supplied to the engine becomes equal to the desired air-fuel ratio, the delaying means delaying the timing of the calculation of the adaptive control correction coefficient.

Also preferably, the air-fuel ratio control system further includes construction-changing means responsive to detection of the deterioration of the response characteristic of the air-fuel ratio sensor by the response characteristic deterioration-detecting means, for changing a construction of the feedback control means according to an increase in an ineffective time representative of responsiveness of the air-fuel ratio control system caused by the deterioration of the response characteristic of the air-fuel ratio sensor detected by the response characteristic deterioration-detecting means.

More preferably, the adaptive controller includes adaptive control means for setting the adaptive control correction coefficient (KSTR), based on the plurality of the adaptive parameters ($\hat{\theta}(k)$) by using a recurrence formula, the recurrence formula having a factor (d) representative of a number of control cycles of the feedback control means, the factor (d) corresponding to the ineffective time, such that the air-fuel ratio of the air-fuel mixture supplied to the engine becomes equal to the desired air-fuel ratio, the construction-changing means setting the factor (d) of the recurrence formula to a larger value.

Further alternatively, to attain the second object, the air-fuel ratio control system according to the invention may include inhibiting means responsive to detection of the deterioration of the response characteristic of the air-fuel ratio sensor by the response characteristic deterioration-detecting means, for inhibiting operation of the first feedback control means.

Further, to attain the second object, the present invention provides an air-fuel ratio control system for an internal combustion engine having an exhaust system, and a crankshaft, comprising:

an air-fuel ratio sensor arranged in the exhaust system;

feedback control means for controlling an amount of fuel to be supplied to the engine in a feedback manner based on an output from the air-fuel ratio sensor by using an adaptive controller of a recurrence formula type, such that an air-fuel ratio of an air-fuel mixture supplied to the engine becomes equal to a desired air-fuel ratio;

operating condition-detecting means for detecting operating conditions of the engine;

sampling means for sampling output values from the air-fuel ratio sensor whenever the crankshaft rotates through a predetermined crank angle, and for sequentially storing the sampled output values;

selecting means for selecting one of the stored sampled output values according to operating conditions of the engine detected by the operating condition-detecting means;

response characteristic deterioration-detecting means for detecting deterioration of a response characteristic of the air-fuel ratio sensor; and sampled value-changing means responsive to detection of the deterioration of the response characteristic of the air-fuel ratio sensor by the response characteristic deterioration-detecting means, for changing the selected sampled output value to one of the output values sampled at later timing;

the feedback control means using the one of the output values sampled at the later timing in controlling the amount of fuel to be supplied to the engine in the feedback manner.

Preferably, the sampled value-changing means determines the later timing according to a deterioration degree of the response characteristic of the air-fuel ratio sensor.

The above and other objects, features, and advantages of the invention will become more apparent from the following detailed description taken in conjunction with the accompanying drawings.

BRIEF DESCRIPTION OF THE DRAWINGS

FIGS. 6A and 6B collectively form a timing chart showing the relationship between generation of TDC signal pulses of the engine and an air-fuel ratio detected at a confluent portion of the exhaust system of the engine (output from the LAF sensor), in which:

FIG. 6A shows TDC signal pulses; and

FIG. 6B shows the output from the LAF sensor;

FIGS. 7A and 7B show good and bad examples of timing of sampling output from the LAF sensor, in which:

FIG. 7A shows examples of sampling timing in relation to the actual air-fuel ratio; and FIG. 7B shows examples of the air-fuel ratio recognized by an ECU through sampling of the output from the LAF sensor;

FIGS. 21A and 21B collectively form a timing chart which is useful in explaining a manner of LAF sensor deterioration determination according to a second embodiment of the invention, in which:

FIG. 21A shows a change in the fuel supply state; and

FIG. 21B shows a change in the actual LAF sensor output;

DETAILED DESCRIPTION

The invention will now be described in detail with reference to drawings showing embodiments thereof.

Figure 1:
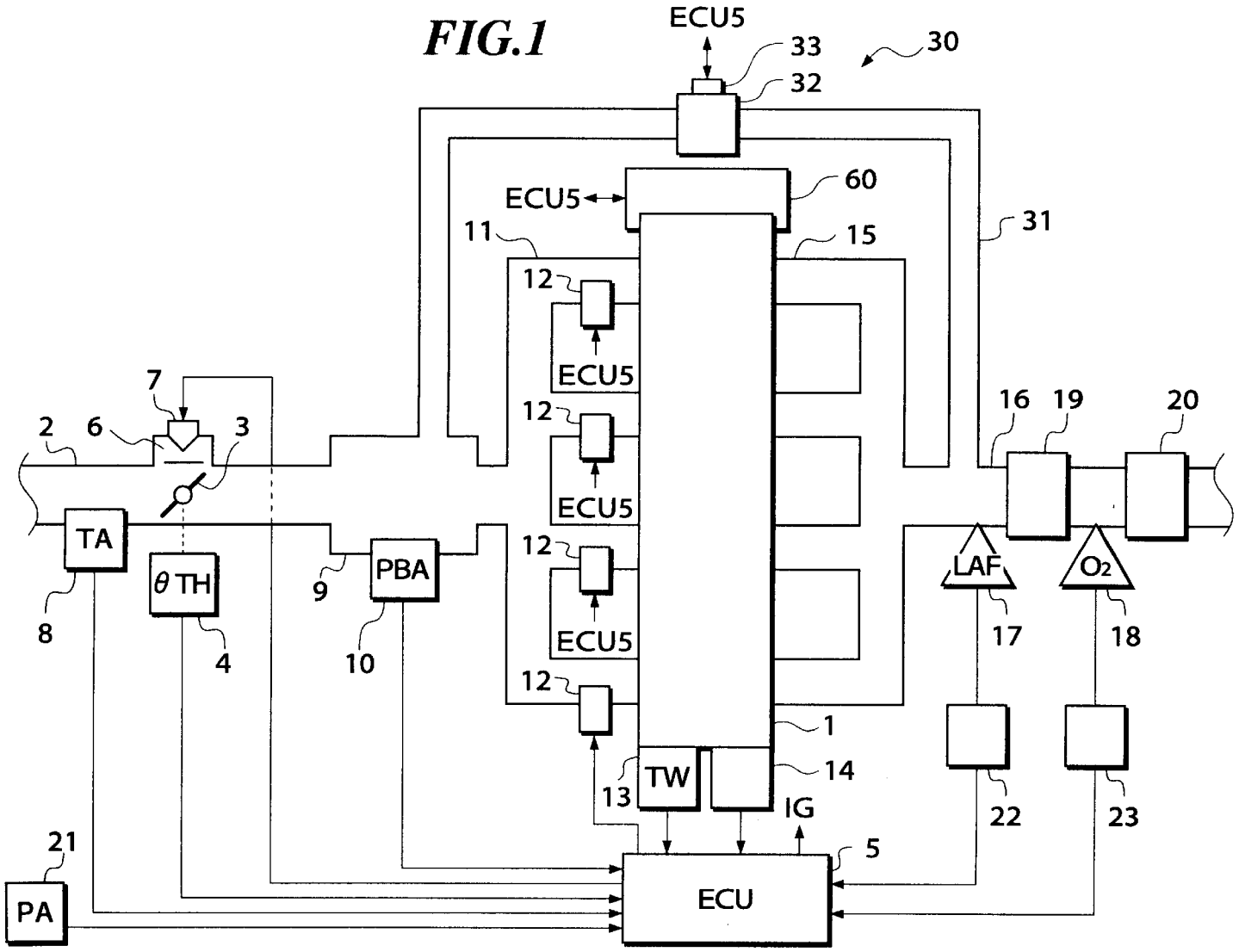
FIG. 1 is a block diagram showing the arrangement of an internal combustion engine and an air-fuel ratio control system therefor, according to a first embodiment of the invention.

Referring first to FIG. 1, there is schematically shown the whole arrangement of an internal combustion engine and an air-fuel ratio control system therefor, according to an embodiment of the invention. in the figure, reference numeral 1 designates a DOHC straight type four-cylinder internal combustion engine (hereinafter simply referred to as "the engine") having a pair of intake valves and a pair of exhaust valves provided for each cylinder, neither of which are shown.

An intake pipe 2 of the engine 1 is connected to a combustion chamber, not shown, of each cylinder of the engine 1, through a confluent portion (intake manifold) 11. Arranged in the intake pipe 2 is a throttle valve 3 to which is connected a throttle valve opening $\hat{\theta}$TH) sensor 4, for generating an electric signal indicative of the sensed throttle valve opening $\hat{\theta}$TH and supplying the same to an electronic control unit (hereinafter referred to as "the ECU") 5. An auxiliary air passage 6 is provided at the intake pipe 2, which bypasses the throttle valve 3. Arranged in the auxiliary air passage 6 is an auxiliary air amount control valve 7 which is connected to the ECU 5 to have its valve lift controlled by a signal therefrom.

An intake air temperature (TA) sensor 8 is inserted into the intake pipe 2 at a location upstream of the throttle valve 3, for supplying an electric signal indicative of the sensed intake air temperature TA to the ECU 5. The intake pipe 2 has a swelled portion as a chamber 9 at a location intermediate between the throttle valve 3 and the intake manifold 11 filled with an engine coolant. An intake pipe absolute pressure (PBA) sensor 10 is provided in communication with the interior of the chamber 9, for supplying an electric signal indicative of the sensed absolute pressure PBA to the ECU 5.

An engine coolant temperature (TW) sensor 13 is mounted in the cylinder block of the engine 1 filled with an engine coolant, for supplying an electric signal indicative of the sensed engine coolant temperature TW to the ECU 5. Connected to the ECU 5 is a crank angle sensor 14 for detecting the rotational angle of a crankshaft, not shown, of the engine 1 and supplying an electric signal indicative of the sensed rotational angle of the crankshaft to the ECU 5.

The crank angle sensor 14 is comprised of a cylinder-discriminating sensor, a TDC sensor, and a CRK sensor. The cylinder-discriminating sensor generates a signal pulse (hereinafter referred to as "a CYL signal pulse") at a predetermined crank angle of a particular cylinder of the engine 1, the TDC sensor generates a signal pulse at each of predetermined crank angles (e.g. whenever the crankshaft rotates through 180 degrees when the engine is of the 4-cylinder type) which each correspond to a predetermined crank angle before a top dead point (TDC) of each cylinder corresponding to the start of the suction stroke of the cylinder, and the CRK sensor generates a signal pulse at each of predetermined crank angles (e.g. whenever the crankshaft rotates through 30 degrees) with a predetermined repetition period shorter than the repetition period of TDC signal pulses. The CYL signal pulse, TDC signal pulse, and CRK signal pulse are supplied to the ECU 5, which are used for controlling various kinds of timing, such as fuel injection timing and ignition timing and for detecting the engine rotational speed NE.

Fuel injection valves 12 are inserted into the intake manifold 11 for respective cylinders at locations slightly upstream of the intake valves. The fuel injection valves 12 are connected to a fuel pump, not shown, and electrically connected to the ECU 5 to have fuel injection timing and fuel injection periods (valve opening periods) thereof controlled by signals therefrom. Spark plugs, not shown, of the engine 1 are also electrically connected to the ECU 5 to have ignition timing $\hat{\theta}$IG thereof controlled by signals therefrom.

An exhaust pipe 16 is connected to the combustion chambers of the engine 1 through an exhaust manifold 15.

A linear-output oxygen concentration sensor (hereinafter referred to as "the LAF sensor") 17 is arranged in the exhaust pipe 16 at a location immediately downstream of a confluent portion of the exhaust pipe 16. Further arranged in the exhaust pipe 16 are a first three-way catalyst (immediate downstream three-way catalyst) 19 and a second three-way catalyst (bed-downstream three-way catalyst) 20, and an oxygen concentration sensor (hereinafter referred to as "the O2 sensor") 18 inserted into the exhaust pipe 16 at a location intermediate between the three-way catalysts 19, 20. The three-way catalysts 19 and 20 function to purify noxious components in exhaust gases, such as HC, CO, and NOx.

The LAF sensor 17 is connected to the ECU 5 via a low-pass filter 22, for generating an electric signal which is almost proportional in value to the concentration of oxygen (air-fuel ratio) in exhaust gases from the engine and supplying the same to the ECU 5. The O2 sensor 18 has a characteristic that an electromotive force thereof drastically changes when the air-fuel ratio of exhaust gases changes across a stoichiometric air-fuel ratio, so that the O2 sensor 18 generates a high level signal when the air-fuel ratio of the exhaust gases is richer than the stoichiometric air-fuel ratio, and a low level signal when it is leaner than the same. The O2 sensor 18 is connected to the ECU 5 via a low-pass filter 23, for supplying a signal indicative of the sensed oxygen concentration to the ECU 5.

The engine 1 is provided with an exhaust gas recirculation (EGR) system 30 which is comprised of an exhaust gas recirculation passage 31 extending between the chamber 9 of the intake pipe 2 and the exhaust pipe 16, an exhaust gas recirculation control valve (hereinafter referred to as "the EGR valve") 32 arranged across the exhaust gas recirculation passage 31, for controlling the amount of exhaust gases to be recirculated, and a lift sensor 33 for detecting the lift of the EGR valve 33 and supplying a signal indicative of the detected valve lift to the ECU 5. The EGR valve 32 is an electromagnetic valve having a solenoid which is connected to the ECU 5, the valve lift of which is linearly changed by a signal from the ECU 5.

The engine 1 has a valve timing changeover mechanism 60 which changes valve timing (inclusive of the valve lift) of the intake valves and exhaust valves between a high-speed valve timing suitable for operation of the engine in a high rotational speed region and a low-speed valve timing suitable for operation of the engine in a low rotational speed region. Further, when the low-speed valve timing is selected, one of the two intake valves is rendered inoperative, whereby stable combustion of the engine is secured even when the air-fuel ratio is controlled to a leaner value than the stoichiometric air-fuel ratio.

The valve timing changeover mechanism 60 changes the valve timing by means of hydraulic pressure, and an electromagnetic valve for changing the hydraulic pressure and a hydraulic pressure sensor, neither of which is shown, are connected to the ECU 5. A signal indicative of the sensed hydraulic pressure is supplied to the ECU 5 which in turn controls the electromagnetic valve for changing the valve timing.

Further connected to the ECU 5 is an atmospheric pressure (PA) sensor 21 for detecting atmospheric pressure and supplying a signal indicative of the sensed value to the ECU 5.

The ECU 5 is comprised of an input circuit having the functions of shaping the waveforms of input signals from various sensors mentioned above, shifting the voltage levels of sensor output signals to a predetermined level, converting analog signals from analog-output sensors to digital signals, and so forth, a central processing unit (hereinafter referred to as "the CPU"), memory means formed of a ROM storing various operational programs which are executed by the CPU, and a RAM for storing results of calculations therefrom, etc., and an output circuit which delivers driving signals to electromagnetic valves such as the fuel injection valves 12 and the EGR valve 32, the spark plugs, etc.

The ECU 5 operates in response to the above-mentioned signals from the sensors to determine operating conditions in which the engine 1 is operating, such as an air-fuel ratio feedback control region in which air-fuel ratio feedback control is carried out in response to outputs from the LAF sensor 17 and the O2 sensor 18, and air-fuel ratio open-loop control regions, and calculates, based upon the determined engine operating conditions, the fuel injection period TOUT over which the fuel injection valves 12 are to be opened, by the use of the following equation (1), to output driving signals for driving the fuel injection valves 12, based on the results of the calculation:

$$TOUT=TIMF\times KTOTAL\times KCMDM\times KFB \quad (1)$$

Figure 2:
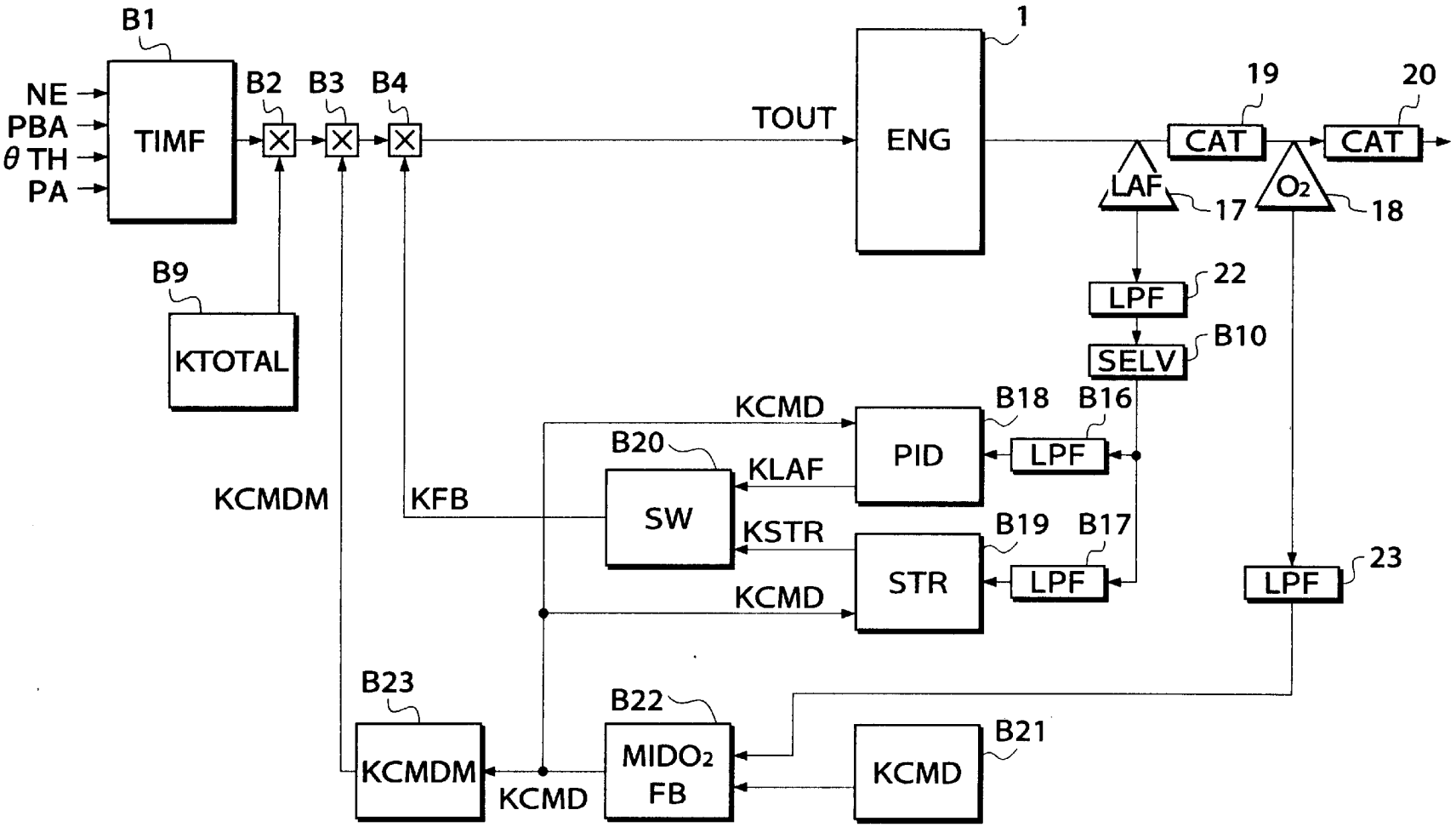
FIG. 2 is a block diagram useful in explaining functions of the air-fuel ratio control system and a manner of calculating a fuel injection period TOUT(N)

FIG. 2 shows an outline of the manner of calculating the fuel injection period TOUT according to the above equation (1), in which various blocks exhibit their functions. In the present embodiment, an amount of fuel supplied to the engine is calculated as the fuel injection period, which corresponds to an amount of fuel to be injected, and therefore the fuel supply amount TOUT will be also referred to as the fuel injection amount or the fuel amount hereinafter.

In the figure, a block B1 calculates a basic fuel amount TIMF based on the intake air amount. The basic fuel amount TIMF is basically set according to the engine rotational speed NE and the intake pipe absolute pressure PBA. Preferably, a model is prepared in advance, which represents a portion of the engine extending from the throttle valve 3 of the intake system to the combustion chamber, and a correction is made to the TIMF value in dependence on a delay of the flow of intake air obtained on the model. In this preferred method, the throttle valve opening $\hat{\theta}$TH and the atmospheric pressure PA are also used as additional parameters indicative of operating conditions of the engine 1.

Reference numerals B2 to B4 designates multiplying blocks, which multiply the basic fuel amount TIMF by parameter values input thereto, and deliver the product values. These blocks carry out the arithmetic operation of the equation (1), and an output from the multiplying block B4 provide fuel injection amounts TOUT for the respective cylinders.

A block B9 multiplies together all feedforward correction coefficients, such as an engine coolant temperature-dependent correction coefficient KTW set according to the engine coolant temperature TW and an EGR-dependent correction coefficient KEGR set according to the amount of recirculation of exhaust gases during execution of the exhaust gas recirculation, to obtain the correction coefficient KTOTAL, which is supplied to the block B2.

A block B21 determines a desired air-fuel ratio coefficient KCMD based on the engine rotational speed NE, the intake pipe absolute pressure PBA, etc. and supplies the same to a block B22. The desired air-fuel ratio coefficient KCMD is directly proportional to the reciprocal of the air-fuel ratio A/F, i.e. the fuel-air ratio F/A, and assumes a value of 1.0 when it is equivalent to the stoichiometric air-fuel ratio. For this reason, this coefficient KCMD will be also referred to as the desired equivalent ratio. The block B22 corrects the desired air-fuel ratio coefficient KCMD based on the output VMO2 from the O2 sensor 18 supplied via the low-pass filter 23, and delivers the corrected KCMD value to a block B18 and the block B23. The block B23 carries out fuel cooling-dependent correction of the corrected KCMD value to calculate a final desired air-fuel ratio coefficient KCMDM and supplies the same to the block B3.

A block B10 samples the output from the LAF sensor 17 supplied via the low-pass filter 22 with a sampling period in synchronism with generation of each CRK signal pulse, sequentially stores the sampled values into a ring buffer memory, not shown, and selects one of the stored values depending on operating conditions of the engine (LAF sensor output-selecting processing), which was sampled at the optimum timing for each cylinder, to supply the selected value to the block B18 and a block B19 via low-pass filter blocks B16 and B17. The LAF sensor output-selecting processing eliminates the inconvenience that the air-fuel ratio, which changes every moment, cannot be accurately detected depending on the timing of sampling of the output from the LAF sensor 17, there is a time lag before exhaust gases emitted from the combustion chamber reach the LAF sensor 17, and the response time of the LAF sensor per se changes depending on operating conditions of the engine.

The block B18 calculates a PID correction coefficient KLAF through PID control based on the difference between the actual air-fuel ratio and the desired air-fuel ratio and delivers the calculated KLAF value to the block B20. The block B19 calculates an adaptive control correction coefficient KSTR through adaptive control (Self-Tuning Regulation), based on the detected air-fuel ratio, and delivers the calculated KSTR value to the block B20. The reason for employing the adaptive control is as follows: If the basic fuel amount TIMF is merely multiplied by the desired air-fuel ratio coefficient KCMD (KCMDM), the resulting desired air-fuel ratio and hence the detected air-fuel ratio may become dull due to a response lag of the engine. The adaptive control is employed to dynamically compensate for the response lag of the engine to thereby improve the toughness of the air-fuel ratio control against external disturbances.

The block B20 selects either the PID correction coefficient KLAF or the adaptive control correction coefficient KSTR supplied thereto, depending upon operating conditions of the engine, and delivers the selected correction coefficient as a feedback correction coefficient KFB to the block B4. This selection is based on the fact that the use of the correction coefficient KLAF calculated by the ordinary PID control can be more suitable for the calculation of the TOUT value than the correction coefficient KSTR, depending on operating conditions of the engine.

According to the present embodiment, as described above, either the PID correction coefficient KLAF calculated by the ordinary PID control in response to the output from the LAF sensor 17, or the adaptive control correction coefficient KSTR calculated by the adaptive control is selectively applied as the correction coefficient KFB to the equation (1) to calculate the fuel injection amount TOUT. When the correction coefficient KSTR is applied, the responsiveness of the air-fuel ratio control exhibited when the desired air-fuel ratio is changed and the toughness of the air-fuel ratio control against external disturbances can be improved, and hence the purification rate of the catalysts can be improved to ensure excellent exhaust emission characteristics of the engine in various operating conditions of the engine.

In the present embodiment, the functions of the various blocks in FIG. 2 are each performed by arithmetic operations by the CPU of the ECU 5, which will be described in detail with reference to flowcharts for carrying out the operations.

Figure 3:
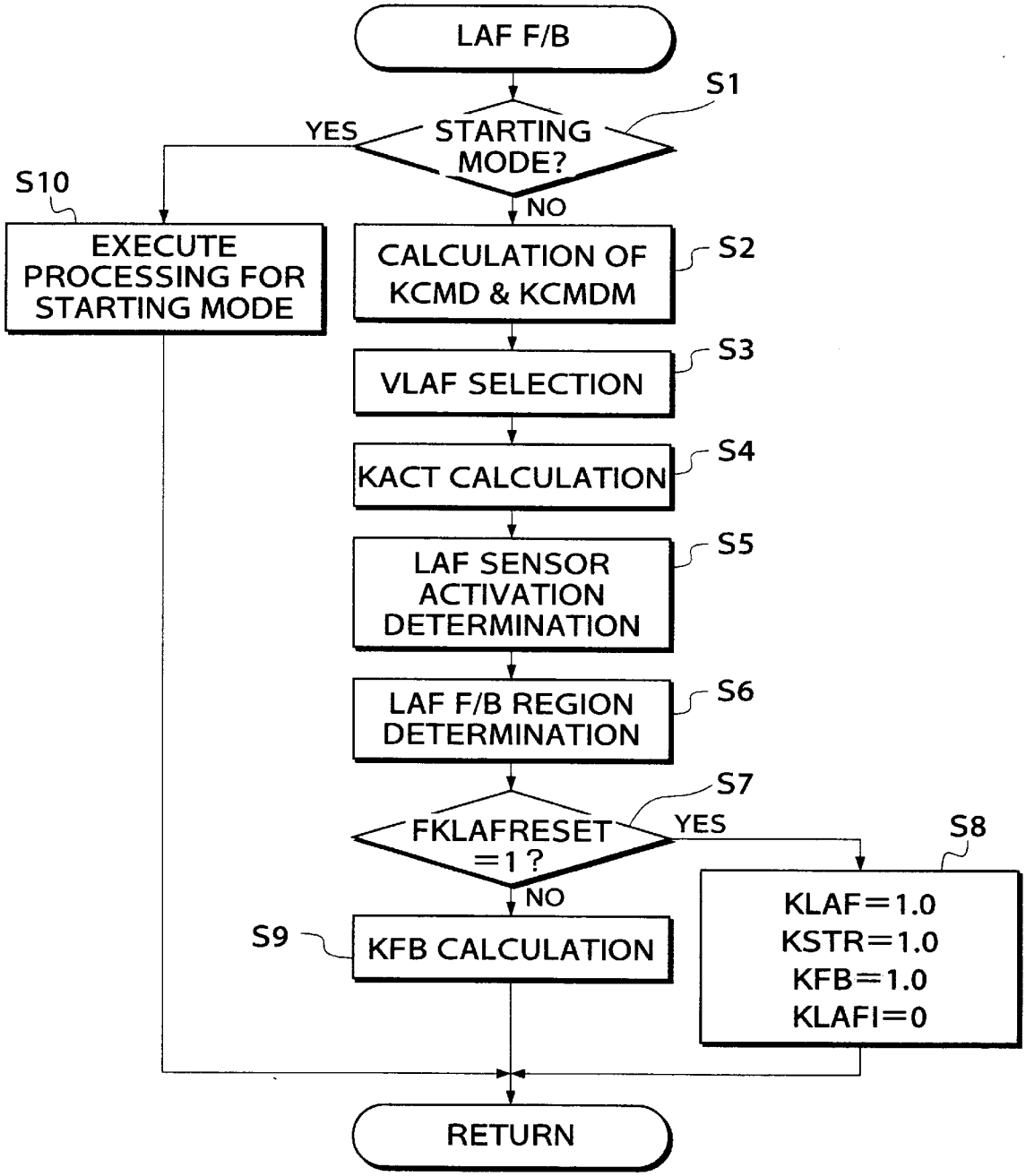
FIG. 3 is a flowchart showing a routine for calculating feedback correction coefficients, based on an output from a LAF sensor appearing in FIG. 1.

FIG. 3 shows a routine for calculating the PID correction coefficient KLAF and the adaptive control correction coefficient KSTR, according to the output from the LAF sensor 17. This routine is executed in synchronism with generation of each TDC signal pulse.

At a step S1, it is determined whether or not the engine is in a starting mode, i.e. whether or not the engine is being cranked. If the engine is in the starting mode, the program proceeds to a step S14 to execute a subroutine for the starting mode. If the engine is not in the starting mode, the desired air-fuel ratio coefficient (the desired equivalent ratio) KCMD and the final desired air-fuel ratio coefficient KCMDM are calculated at a step S2, and the LAF sensor output-selecting processing is executed at a step S3. Further, the actual equivalent ratio KACT is calculated at a step S4. The actual equivalent ratio KACT is obtained by converting the output from the LAF sensor 17 to an equivalent ratio value.

Then, it is determined at a step S5 whether or not the LAF sensor 17 has been activated. This determination is carried out by comparing the difference between the output voltage from the LAF sensor 17 and a central voltage thereof with a predetermined value (e.g. 0.4 V), and determining that the LAF sensor 17 has been activated when the difference is smaller than the predetermined value.

Then, it is determined at a step S6 whether or not the engine 1 is in an operating region in which the air-fuel ratio feedback control responsive to the output from the LAF sensor 17 is to be carried out (hereinafter referred to as "the LAF feedback control region"). More specifically, it is determined that the engine 1 is in the LAF feedback control region e.g. when the LAF sensor 17 has been activated but at the same time neither fuel cut nor wide open throttle operation is being carried out. If it is determined at this step that the engine is not in the LAF feedback control region, a reset flag FKLAFRESET is set to "1", whereas if it is determined the engine is in the LAF feedback control region, the reset flag FKLAFRESET is set to "0".

At the following step S7, it is determined whether or not the reset flag FKLAFRESET assumes "1". If FKLAFRESET=1, the program proceeds to a step S8, wherein the PID correction coefficient KLAF, the adaptive control correction coefficient KSTR, and the feedback correction coefficient KFB are all set to "1.0", and an integral term KLAFI of the PID control is set to "0", followed by terminating the present program. On the other hand, if FKLAFRESET=0 holds, the feedback correction coefficient KFB is calculated at a step S9, followed by terminating the present program.

Figure 4:
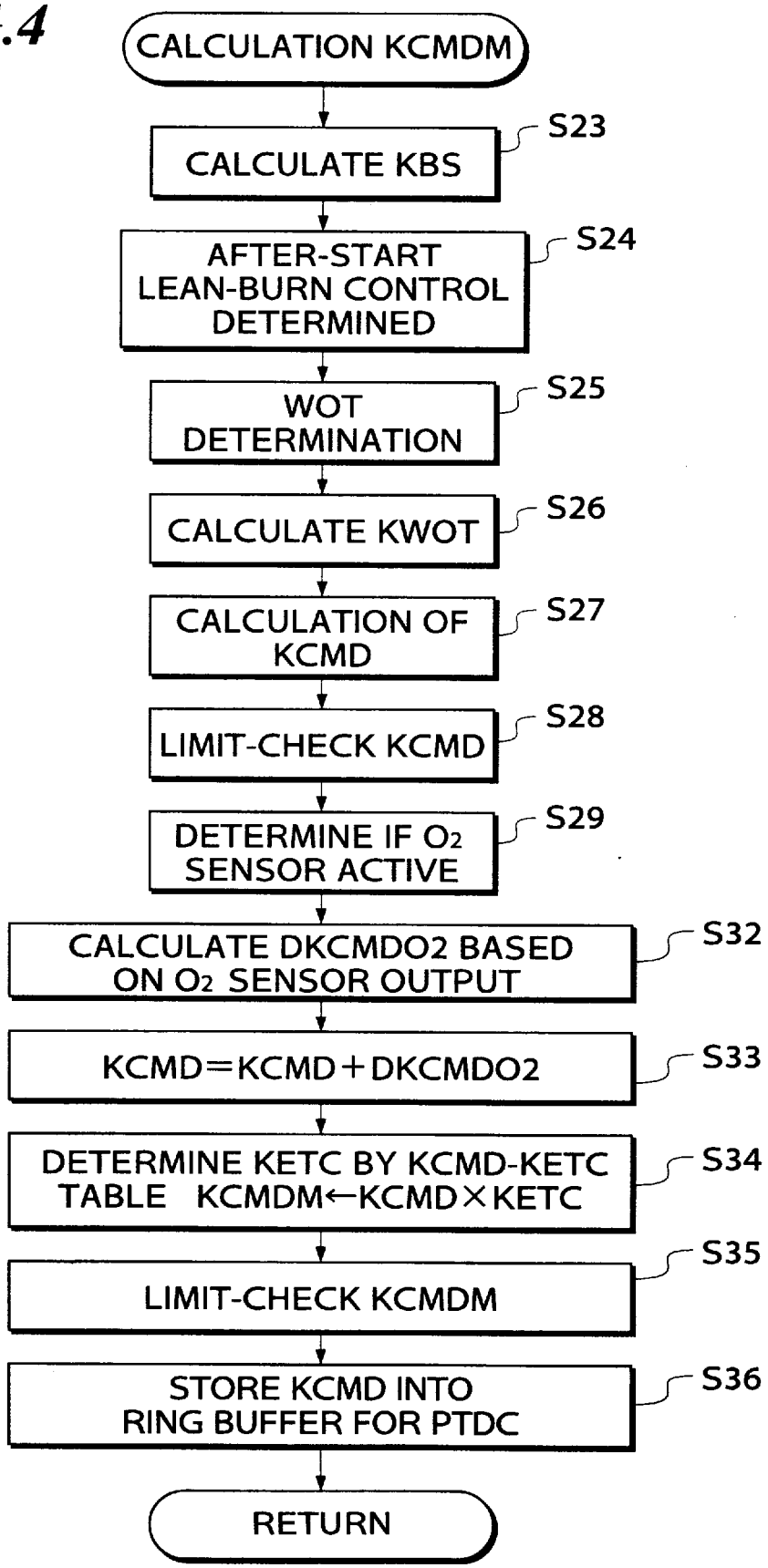
FIG. 4 is a flowchart showing a subroutine for calculating a final desired air-fuel ratio coefficient KCMDM, which is executed at a step S2 in FIG. 3.

FIG. 4 shows a subroutine for executing the step S2 of the FIG. 3 routine to calculate the final desired air-fuel ratio correction coefficient KCMDM.

At a step S23, a basic value KBS is determined by retrieving a map according to the engine rotational speed NE and the intake pipe absolute pressure PBA. The map also contains values of the basic value KBS to be applied during idling of the engine.

At the following step S24, it is determined whether or not conditions for carrying out so-called after-start lean-burn control are fulfilled (after-start-leaning determination). If the conditions are fulfilled, an after-start leaning flag FASTLEAN is set to "1", whereas if they are not fulfilled, the flag FASTLEAN is set to "0". The conditions for the after-start lean-burn control are determined to be fulfilled when a predetermined time period has not elapsed after the start of the engine and at the same time the engine coolant temperature TW, the engine rotational speed NE and the intake pipe absolute pressure PBA are within respective predetermined ranges. The after-start lean-burn control is carried out for the purpose of preventing an increase in emission of HC occurring when the catalysts are inactive immediately after the start of the engine, as well as reducing the fuel consumption.

Then, at a step S25, it is determined whether or not the throttle valve is fully open (i.e. the engine is in a WOT condition). If the throttle valve is fully open, a WOT flag FWOT is set to "1", whereas if the throttle valve is not fully open, the same flag is set to "0". Then, an enriching correction coefficient KWOT is calculated according to the engine coolant temperature TW at a step S26. At the same time, a correction coefficient KXWOT to be applied in a high coolant temperature condition is also calculated.

At the following step S27, the desired air-fuel ratio coefficient KCMD is calculated, and then limit-checking of the calculated KCMD value is carried out to limit the KCMD value within a range defined by predetermined upper and lower limit values at a step S28. A subroutine for executing the step S27 will be described in detail hereinafter with reference to FIG. 5.

At the following step S29, it is determined whether or not the O2 sensor 18 has been activated. If the O2 sensor 18 has been activated, an activation flag FMO2 is set to "1", whereas if the O2 sensor has not been activated, the same flag is set to "0". The O2 sensor 18 is determined to have been activated e.g. when a predetermined time period has elapsed after the start of the engine. At the following step S32, a correction term DKCMD02 for correcting the desired air-fuel ratio coefficient KCMD is calculated according to the output VMO2 from the O2 sensor 18. More specifically, the correction term DKCMDO2 is calculated by the PID control according to a difference between the O2 sensor output VMO2 and a reference value VREFM.

Then, at a step S33, the desired air-fuel ratio coefficient KCMD is corrected by the use of the following equation (2):

$$KCMD=KCMD+DKCMDO2 \quad (2)$$

This correction makes it possible to set the desired air-fuel ratio coefficient KCMD such that a deviation of the LAF sensor output from a proper value is corrected.

At the following step S34, a KCMD-KETC table is retrieved according to the calculated KCMD value to determine a correction coefficient KETC, and the final desired air-fuel ratio coefficient KCMDM is calculated by the use of the following equation (3):

$$KCMDM=KCMD\times KETC \quad (3)$$

The correction coefficient KETC compensates for the influence of fuel cooling effects caused by fuel injection, the degree of which increases as the KCMD value increases to increase the fuel injection amount. The correction coefficient KETC is set to a larger value-as the KCMD value is larger.

Then, limit-checking of the calculated KCMDM value is carried out at a step S35, and the KCMD value obtained at the step S33 is stored in a ring buffer memory at a step S36, followed by terminating the subroutine.

Figure 5:
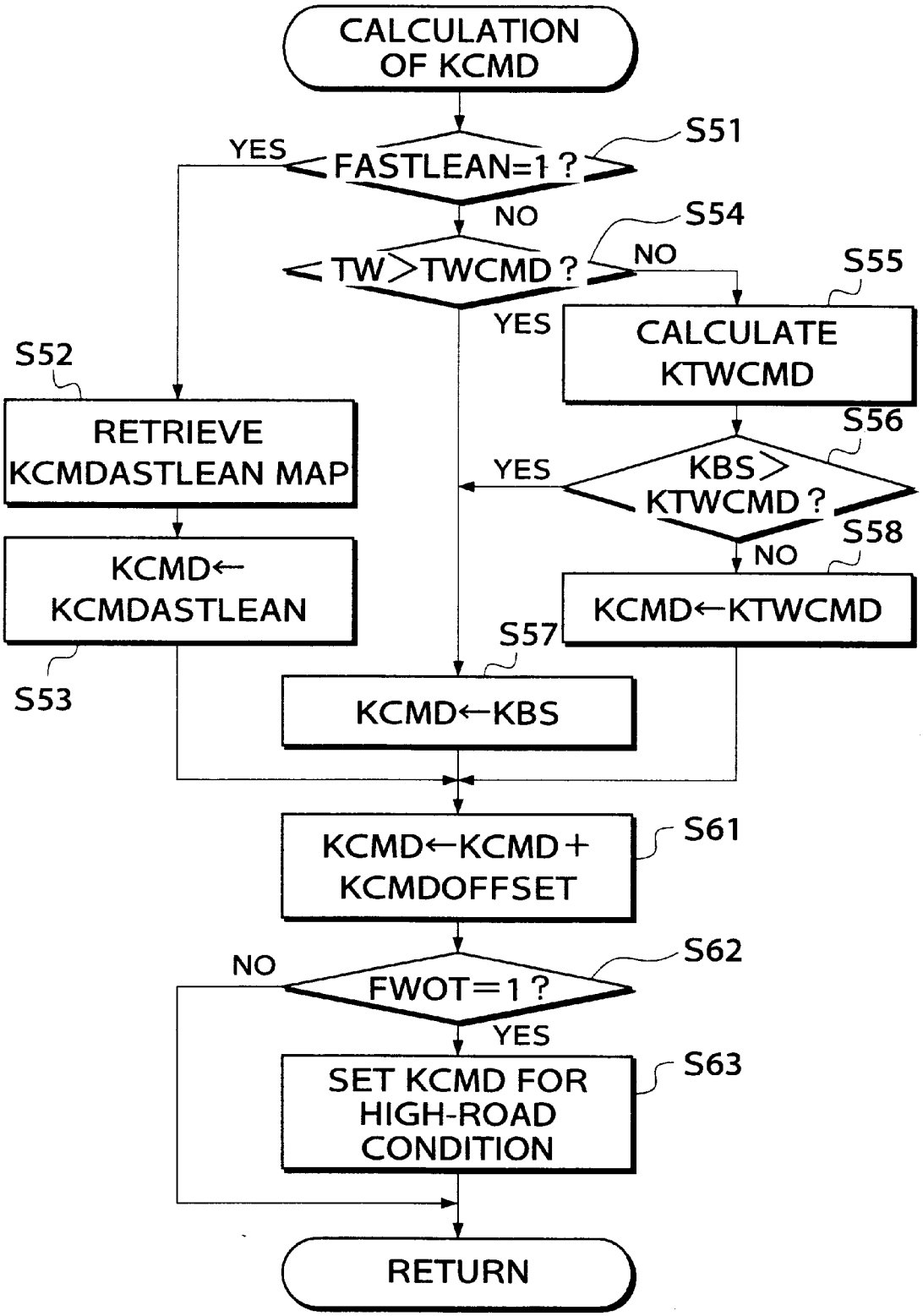
FIG. 5 is a flowchart showing a subroutine for calculating a desired air-fuel ratio coefficient KCMD, which is executed at a step S27 in FIG. 4.

FIG. 5 shows a subroutine for calculating the KCMD value, which is executed at the step S27 in FIG. 4.

First, at a step S51, it is determined whether or not the after-start leaning flag FASTLEAN which has been set at the step S24 in FIG. 4 is equal to "1", and if FASTLEAN=1 holds, a KCMDASTLEAN map is retrieved to determine a leaning desired value KCMDASTLEAN which corresponds to a central air-fuel ratio suitable for the after-start lean-burn control, at a step S52. The KCMDASTLEAN map is set such that map values of the leaning desired value KCMDASTLEAN are set according to the engine coolant temperature TW and the intake pipe absolute pressure PBA. Then, at a step S53 the desired air-fuel ratio coefficient KCMD is set to the thus determined KCMDASTLEAN value, followed by the program proceeding to a step S61.

On the other hand, if FASTLEAN=0 holds at the step S51, which means that the conditions for executing the after-start lean-burn control are not satisfied, it is determined whether or not the engine coolant temperature TW is higher than a predetermined value TWCMD (e.g. 80° C.). If TW>TWCMD holds, the KCMD value is set to the basic value KBS calculated at the step S23 in FIG. 4, at a step S57, followed by the program proceeding to the step S61. If TW≦TWCMD holds, a map which is set according to the engine coolant temperature TW and the intake pipe absolute pressure PBA is retrieved to determine a desired value KTWCMD suitable for low coolant temperature at a step S55, and then it is determined at a step S56 whether or not the basic value KBS is larger than the determined KTWCMD value. If KBS>KTWCMD holds, the program proceeds to the step S57, whereas if KBS≦KTWCMD holds, the KCMD value is replaced by the determined desired value KTWCMD suitable for low coolant temperature at a step S58, followed by the program proceeding to the step S61.

At the step S61, the KCMD value is corrected by the use of the following equation (4), followed by the program proceeding to a step S62:

$$KCMD=KCMD+KCMDOFFSET \quad (4)$$

where KCMDOFFSET represents an addend correction term for finely adjusting the desired air-fuel ratio coefficient KCMD so as to compensate for variations in characteristics of the exhaust system and the LAF sensor of the engine, as well as changes in the exhaust system and the LAF sensor due to aging such that the actual air-fuel ratio assumes an optimum value for window zones of the three-way catalysts. The addend correction term KCMDOFFSET is set based on the characteristics of the LAF sensor 17, etc. Desirably, the KCMDOFFSET value is a learned value obtained by learning based on the output from the O2 sensor 18, etc.

At a step S62, it is determined whether or not the WOT flag FWOT which has been set at the step S25 in FIG. 4 is equal to "1". If FWOT=0 holds, the program is immediately terminated, whereas if FWOT=1 holds, the desired air-fuel ratio correction coefficient KCMD is set to a value suitable for a high-load condition of the engine at a step S63, followed by terminating the present program. The step S63 is executed more specifically by comparing the KCMD value with the enriching correction coefficients KWOT and KXWOT for the high-load condition of the engine calculated at the step S26 of the FIG. 4 routine, and if the KCMD value is smaller than these values, the KCMD value is multiplied by the correction coefficient KWOT or KXWOT for correction of the same.

Next, the LAF sensor output-selecting processing at the step S3 of the FIG. 3 routine will be described.

Exhaust gases are emitted from the engine on the exhaust stroke, and accordingly clearly the behavior of the air-fuel ratio detected at the confluent portion of the exhaust system of the multi-cylinder engine is synchronous with generation of each TDC signal pulse. Therefore, detection of the air-fuel ratio by the LAF sensor 17 is also required to be carried out in synchronism with generation of each TDC signal pulse. However, depending on the timing of sampling the output from the LAF sensor 17, there are cases where the behavior of the air-fuel ratio cannot be accurately grasped. For example, if the air-fuel ratio detected at the confluent portion of the exhaust system varies as shown in FIG. 6B in comparison with timing of generation of each TDC signal pulse shown in FIG. 6A, the air-fuel ratio recognized by the ECU 5 can have quite different values depending on the timing of sampling, as shown in FIG. 7B. Therefore, it is desirable that the sampling of the output from the LAF sensor 17 should be carried out at such timing as enables the ECU 5 to recognize actual variation of the sensor output as accurately as possible.

Further, the variation of the air-fuel ratio also depends upon a time period required to elapse before exhaust gases emitted from the cylinder reach the LAF sensor 17 as well as upon the response time of the LAF sensor 17. The required time period depends on the pressure and volume of exhaust gases, etc. Further, sampling of the sensor output in synchronism with generation of each TDC signal pulse-is equivalent to sampling of the same based on the crank angle position, so that the sampling result is inevitably influenced by the engine rotational speed NE. The optimum timing of detection of the air-fuel ratio thus largely depends upon operating conditions of the engine.

Figure 8:
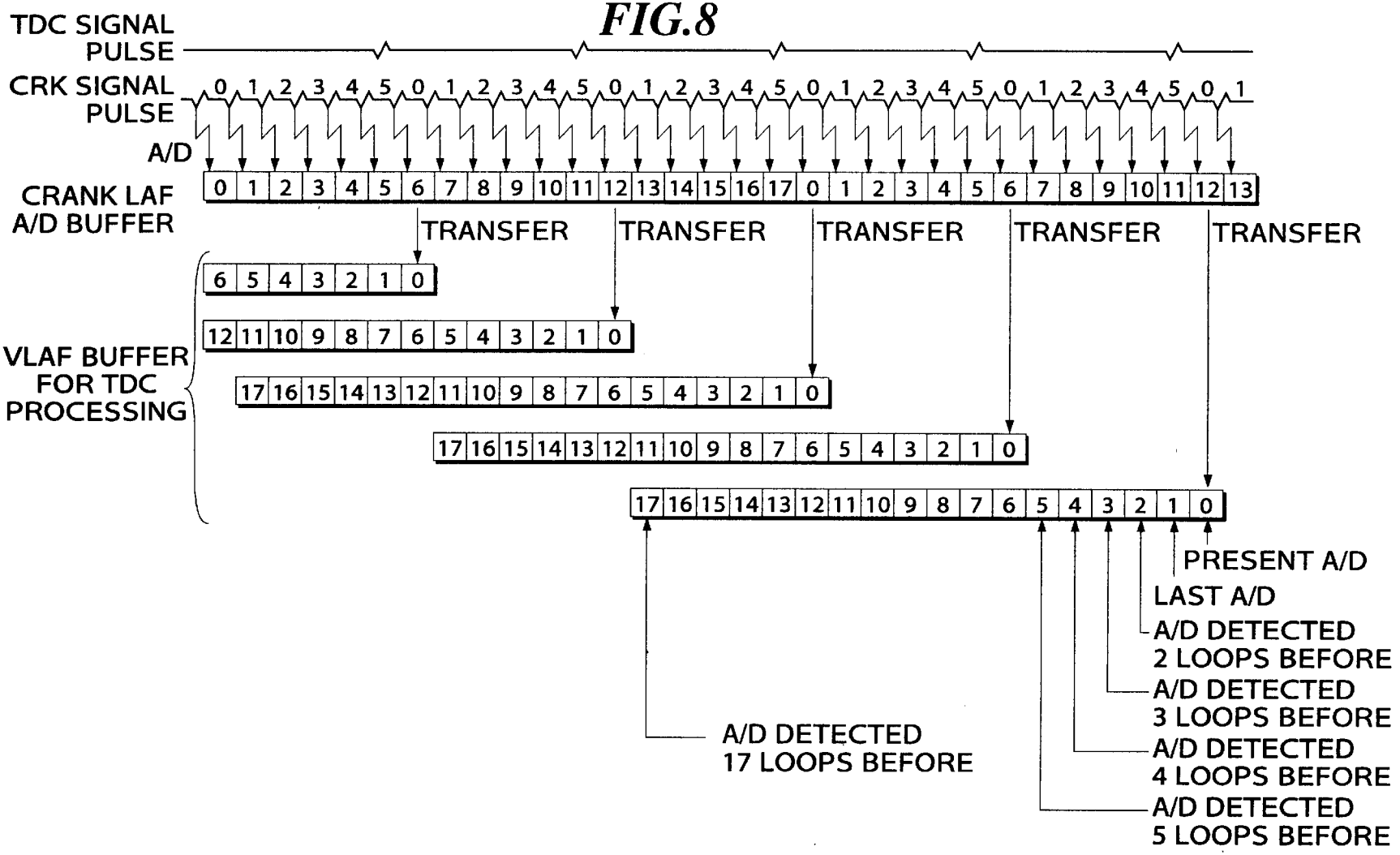
FIG. 8 is a diagram which is useful in explaining how to select a value of the output from the LAF sensor sampled at the optimum timing from values of the same sampled whenever a CRK signal pulse is generated.

In view of the above fact, in the present embodiment, as shown in FIG. 8, values of the output from the LAF sensor 17 sampled in synchronism generation of each CRK signal pulse (at crank angle intervals of 30 degrees) are sequentially stored in the ring buffer memory (having 18 storage locations in the present embodiment), and one sampled at the optimum timing (selected out of the values from a value obtained 17 loops before to the present value) is converted to the actual equivalent ratio KACT for use in the feedback control.

Figure 9:
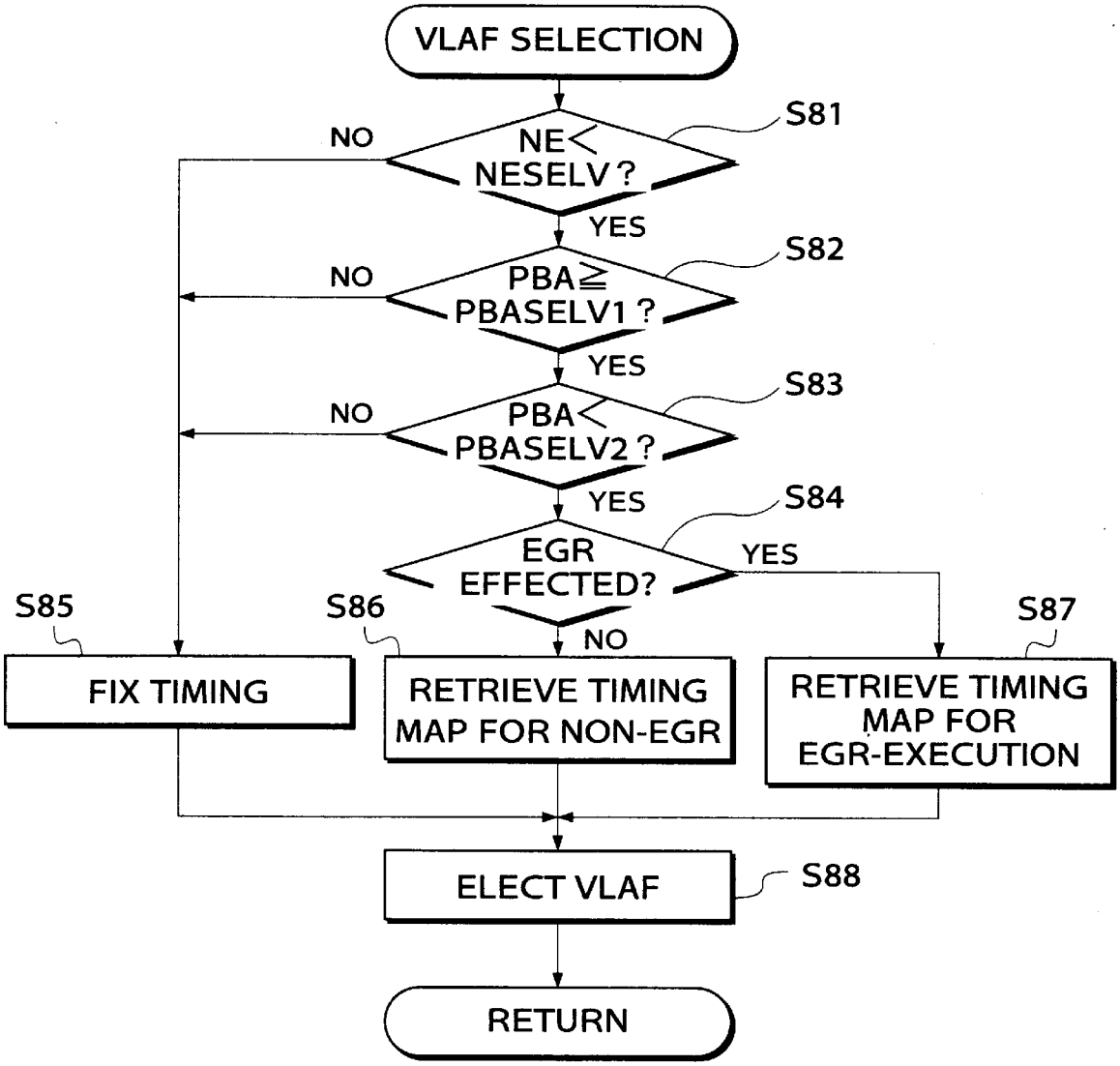
FIG. 9 is a flowchart showing a subroutine for executing a LAF sensor output selection.

FIG. 9 shows a subroutine for carrying out the LAF sensor output selection executed at the step S3 in FIG. 3.

First, at a step S81, it is determined whether or not the engine rotational speed NE is lower than a predetermined value NESELV, and if NE<NESELV holds, it is determined at a step S82 whether or not the intake pipe absolute pressure PBA is higher than a predetermined value PBASELV1. If PBA≧PBASELV1 holds, it is further determined at a step S83 whether or not the PBA value is lower than a predetermined value PBASELV2 (>PBASELV1). If any of the answers to the questions of the steps S81 to S83 is negative (NO), the sampling timing is set to a fixed value at a step S85, and a LAF sensor output VLAF value stored in the ring buffer memory is selected according to the fixed value of the sampling timing at a step S88, followed by terminating the present program.

On the other hand, if the answers to the questions of the steps S81 to S83 are all affirmative (YES), it is determined at a step S84 whether or not the exhaust gas recirculation (EGR) is being carried out. If the EGR is being carried out, a timing map for use during EGR is retrieved according to the detected engine rotational speed NE and intake pipe absolute pressure PBA, at a step S87. On the other hand, if the EGR is not being carried, a timing map for use during non-EGR is retrieved at a step S86. Then, based on the result of the retrieval, a LAF sensor output VLAF value stored in the ring buffer memory is selected at a step S88, followed by terminating the present program.

Figure 10:
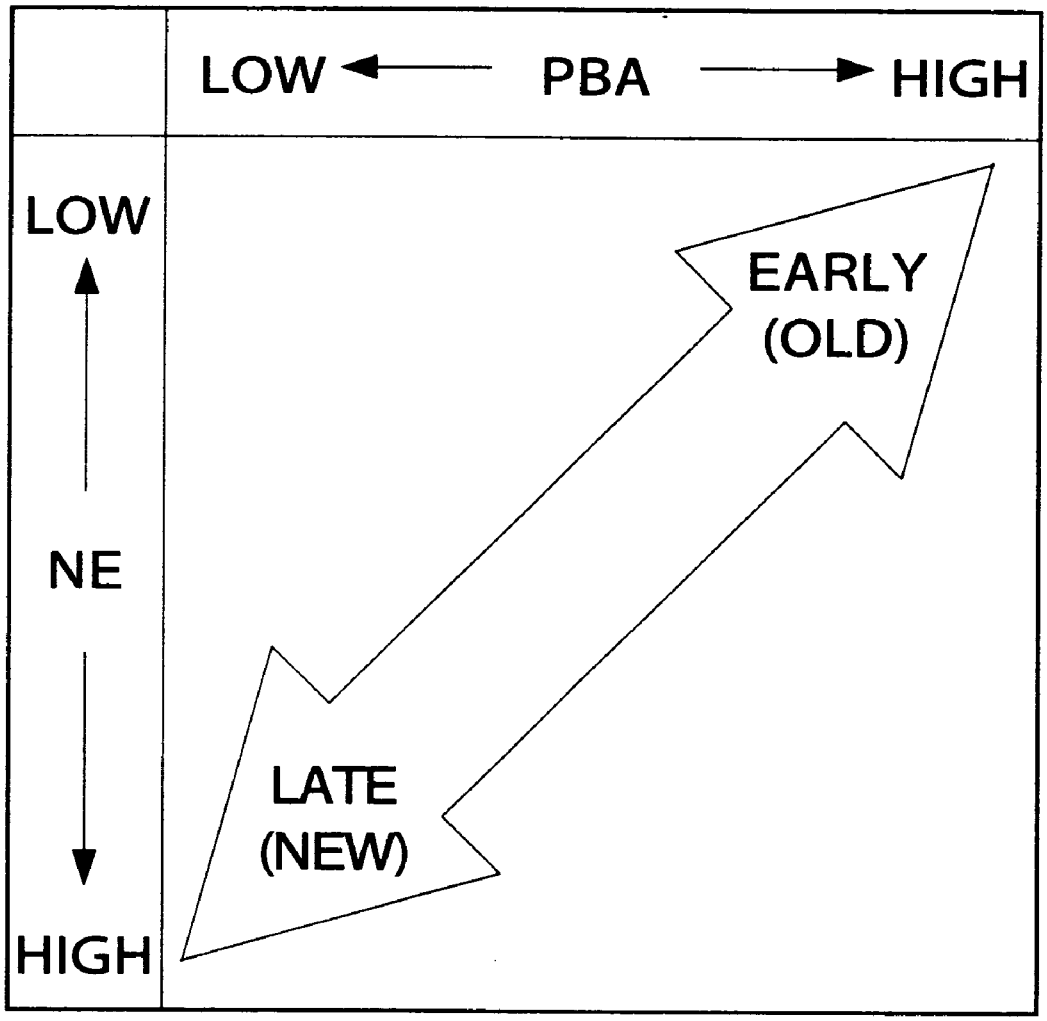
FIG. 10 is a diagram showing characteristics of timing maps used in the FIG. 9 subroutine.
Figure 11A:
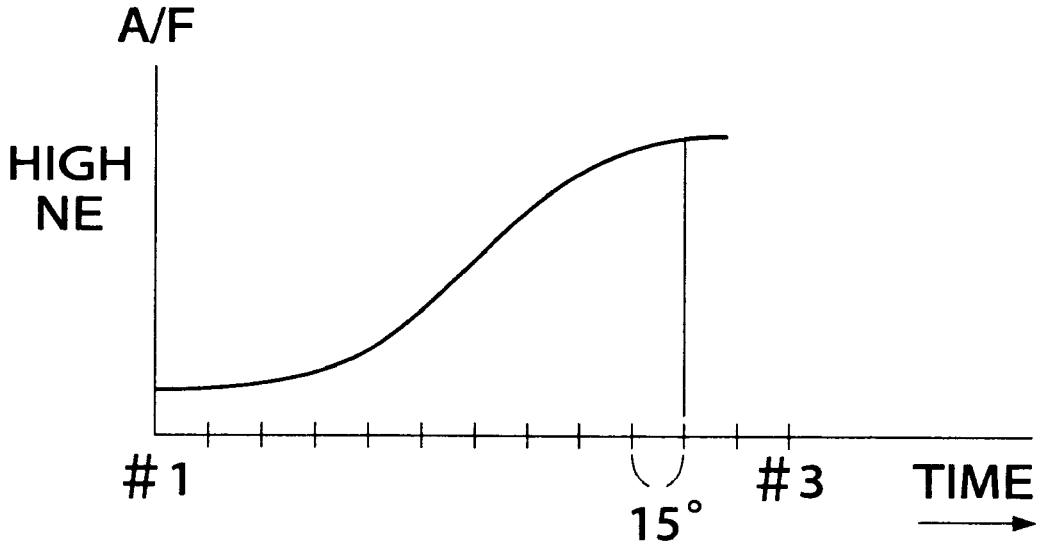
FIG. 11A is a diagram showing characteristics of the output from the LAF sensor assumed at a high engine rotational speed, which is useful in explaining the characteristics of the timing maps shown in FIG. 10.
Figure 11B:
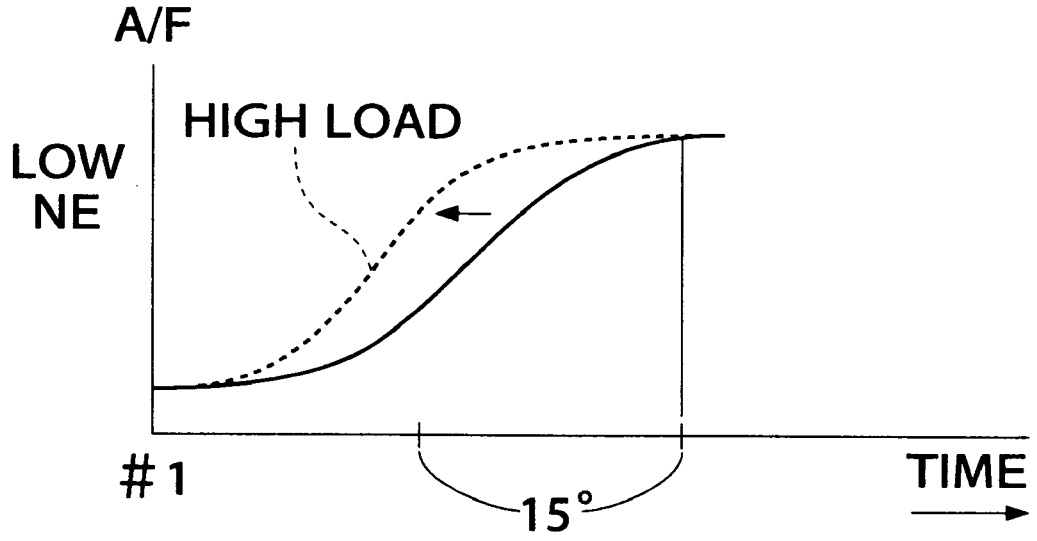
FIG. 11B is a diagram showing characteristics of the output from the LAF sensor assumed at a low engine rotational speed with a shift to be effected when a change in load on the engine occurs, which is useful in explaining the characteristics of the timing maps shown in FIG. 10.

The timing maps are set e.g. as shown in FIG. 10 such that as the engine rotational speed NE is lower and/or the intake pipe absolute pressure PBA is higher, a value sampled at an earlier crank angle position is selected. The word "earlier" in this case means "closer to the immediately preceding TDC position of the cylinder" (in other words, an "older" sampled value is selected). The setting of these maps is based on the fact that as shown in FIGS. 7A and 7B referred to before, the air-fuel ratio is best sampled at timing closest to time points corresponding to maximal and minimal values (hereinafter both referred to as "extreme values" of the actual air-fuel ratio), and assuming that the response time of the LAF sensor 17 is constant, an extreme value, e.g. a first peak value, occurs at an earlier crank angle position as the engine rotational speed NE is lower, and the pressure and volume of exhaust gases emitted from the cylinders increase with increase in the load on the engine, so that the exhaust gases reach the LAF sensor 17 in a shorter time period, as shown in FIG. 11A and 11B.

As described above, according to the FIG. 9 subroutine, the sensor output VLAF value sampled at the optimum timing is selected depending on operating conditions of the engine which improves the accuracy of detection of the air-fuel ratio.

Further, when abnormality of the CRK sensor is detected, the LAF sensor output obtained at the time of generation of each TDC signal pulse is employed.

Figure 12:
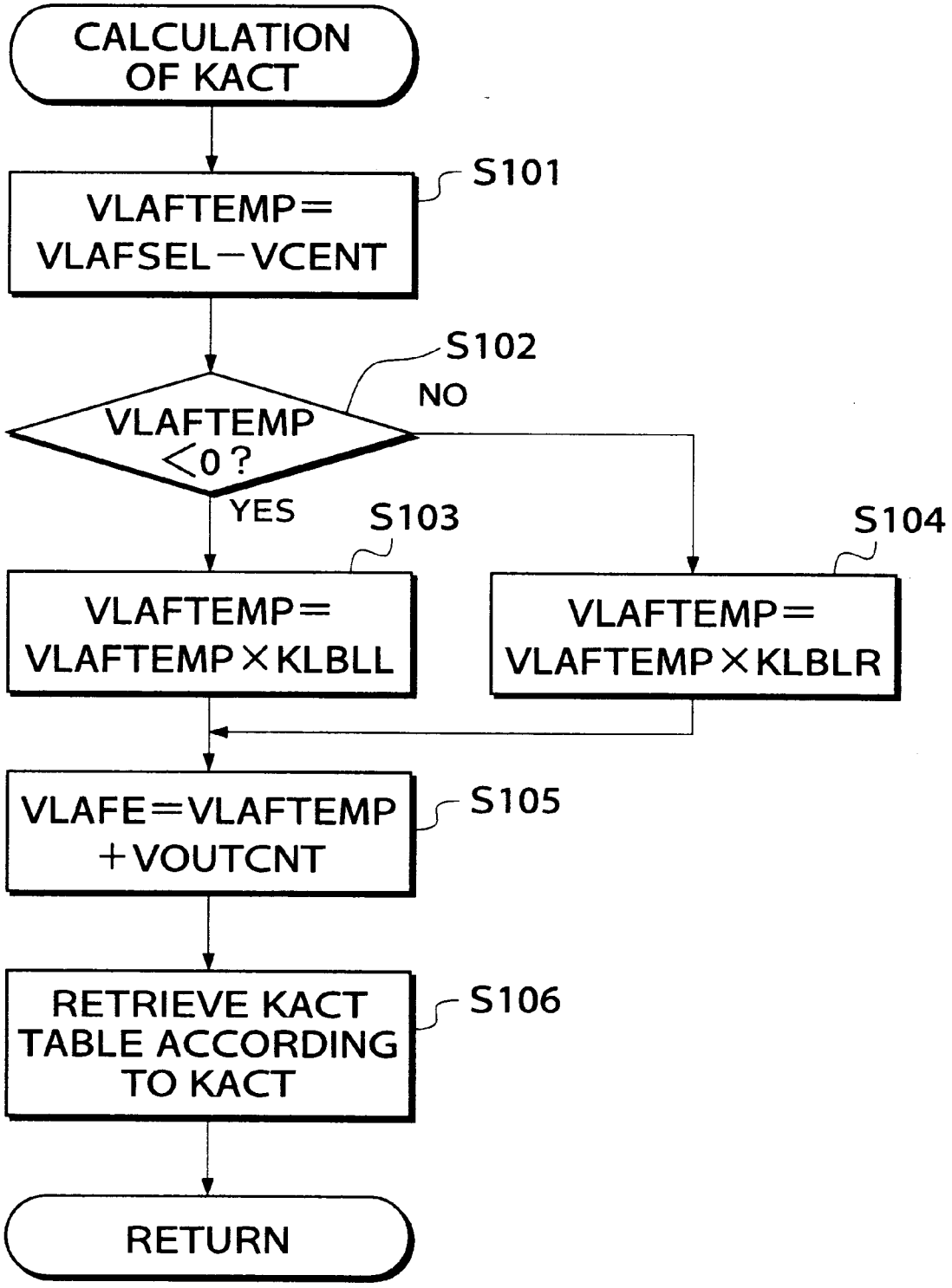
FIG. 12 is a flowchart showing a subroutine for calculating an actual equivalent ratio KACT, which is executed at a step S4 in FIG. 3.

Then, the calculation of the actual equivalent ratio KACT executed at the step S4 of the FIG. 3 routine will be described with reference to FIG. 12.

First, at a step S101, a central value VCENT of the sensor output is subtracted from the selected sensor output value VLAFSEL determined by the FIG. 9 subroutine to obtain a temporary value VLAFTEMP. The central value VCENT is a value of the output from the LAF sensor 17 detected when the air-fuel ratio of the mixture is equal to the stoichiometric air-fuel ratio.

Next, it is determined at a step S102 whether or not the temporary value VLAFTEMP is negative. If VLAFTEMP<0 holds, which means that the actual air-fuel ratio is leaner than the stoichiometric air-fuel ratio, the VLAFTEMP value is multiplied by a lean value correction coefficient KLBLL for correction of the same at a step S103. On the other hand, if VLAFTEMP≧0 holds, which means that the air-fuel ratio is richer than the stoichiometric air-fuel ratio, the VLAFTEMP value is multiplied by a rich value correction coefficient KLBLR for correction of the same at a step S104. The lean value correction coefficient KLBLL and the rich value correction coefficient KLBLR are calculated according to a label resistance value indicated on the LAF sensor 17 for correcting variations in sensor output value between LAF sensors to be employed. The label resistance value is set according to output characteristics of the LAF sensor measured in advance, and the ECU 5 reads the label resistance value to determine the correction coefficients KLBLL, KLBLR.

At the following step S105, a table central value VOUTCNT is added to the temporary value VLAFTEMP to calculate a corrected output value VLAFE, and a KACT table is retrieved according to the corrected output value VLAFE to determine the actual equivalent ratio KACT at a step S106. In the KACT table, the table central value VOUTCNT corresponds to lattice point data corresponding to the stoichiometric air-fuel ratio (KACT=1.0).

By the above processing, the actual equivalent ratio KACT can be obtained which is free of the influence of undesired variations in output characteristics between individual LAF sensors employed.

Figure 13:
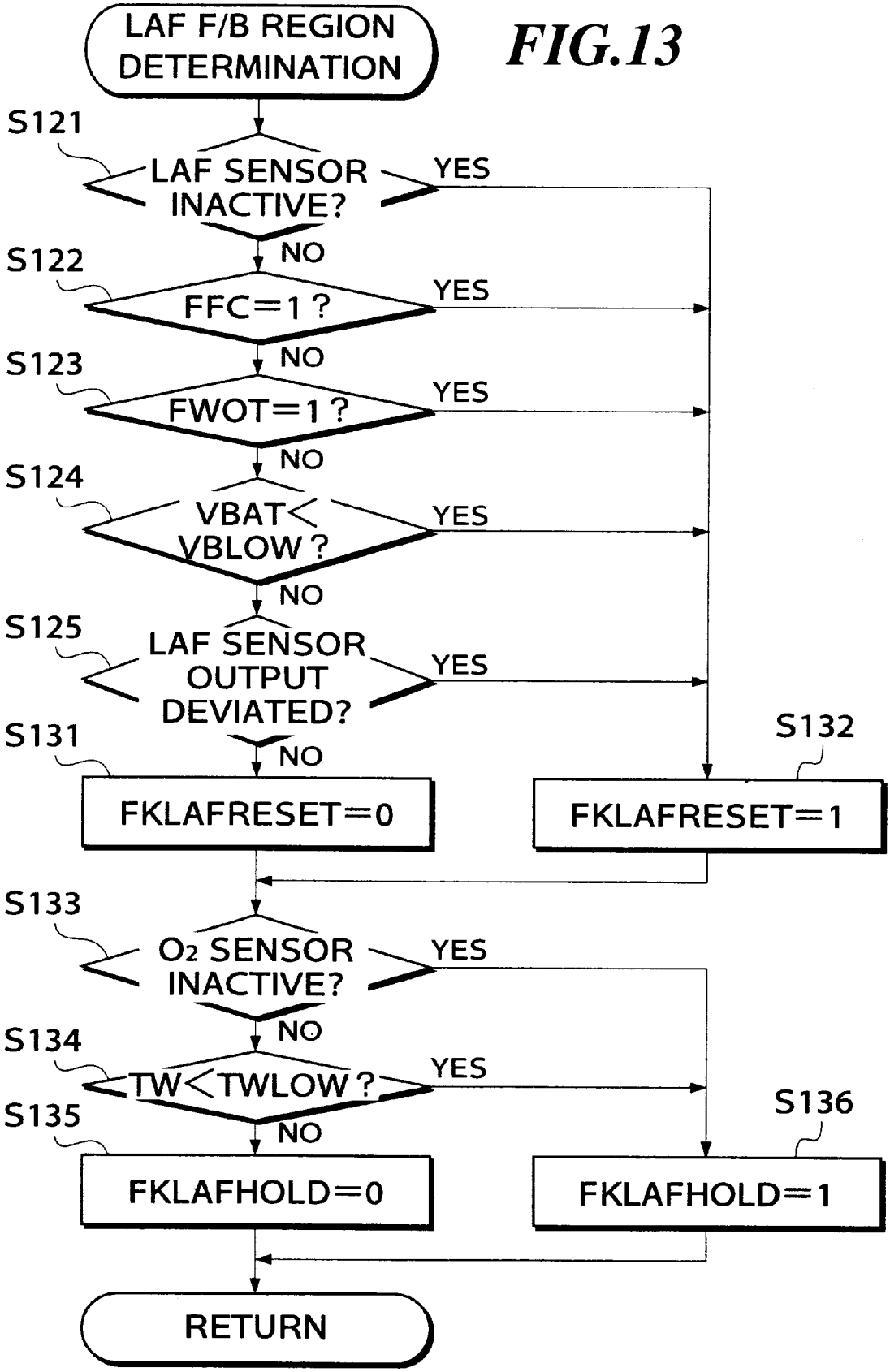
FIG. 13 is a flowchart showing a subroutine for determining whether the engine is operating in an LAF feedback control region, which is executed at a step S6 in FIG. 3.

FIG. 13 shows a LAF feedback control region-determining routine executed at the step S6 in the FIG. 3 routine.

First, at a step S121, it is determined whether or not the LAF sensor 17 is inactive. If the LAF sensor 17 is inactive, it is determined at a step S122 whether or not a flag FFC, which is set to "1" to indicate that fuel cut is being carried out, assumes "1". If FFC=0 holds, it is determined at a step S123 whether or not the WOT flag FWOT, which is set to "1" to indicate that the engine is operating in the wide open throttle condition, assumes "1". If FWOT=0 holds, it is determined at a step S124 whether or not battery voltage VBAT detected by a battery voltage sensor, not shown, is lower than a predetermined lower limit value VBLOW. If VBAT≧VBLOW holds, it is determined at a step S125 whether or not there is a deviation of the LAF sensor output from the proper value corresponding to the stoichiometric air-fuel ratio (LAF sensor output deviation). If any of the answers to the questions of the steps S121 to S125 is affirmative (YES), the KLAF reset flag FKLAFRESET, which is set to "1" to indicate that the feedback control based on the LAF sensor should be inhibited, is set to "1" at a step S132.

On the other hand, if all the answers to the questions of the steps S121 to S125 are negative (NO), the KLAF reset flag FKLAFRESET is set to "0" at a step S131.

At the following step S133, it is determined whether or not the O2 sensor 18 is inactive. If the O2 sensor 18 is active, it is determined at a step S134 whether or not the engine coolant temperature TW is lower than a predetermined lower limit value TWLOW (e.g. 0° C.). If the O2 sensor 18 is inactive or if TW<TWLOW holds, a hold flag FKLAFHOLD, which is set to "1" to indicate that the PID correction coefficient KLAF should be held at the present value, is set to "1" at a step S136, followed by terminating the program. If the O2 sensor 18 is active and at the same time TW≧TWLOW holds, the hold flag FKLAFHOLD is set to "0" at a step S135, followed by terminating the program.

Next, a subroutine for executing the step S9 in the FIG. 3 routine to calculate the feedback correction coefficient KFB will be described.

The feedback correction coefficient KFB is set to the PID correction coefficient KLAF or to the adaptive control correction coefficient KSTR according to operating conditions of the engine. First, manners of calculating these correction coefficients will be described with reference to FIGS. 14 and 15.

Figure 14:
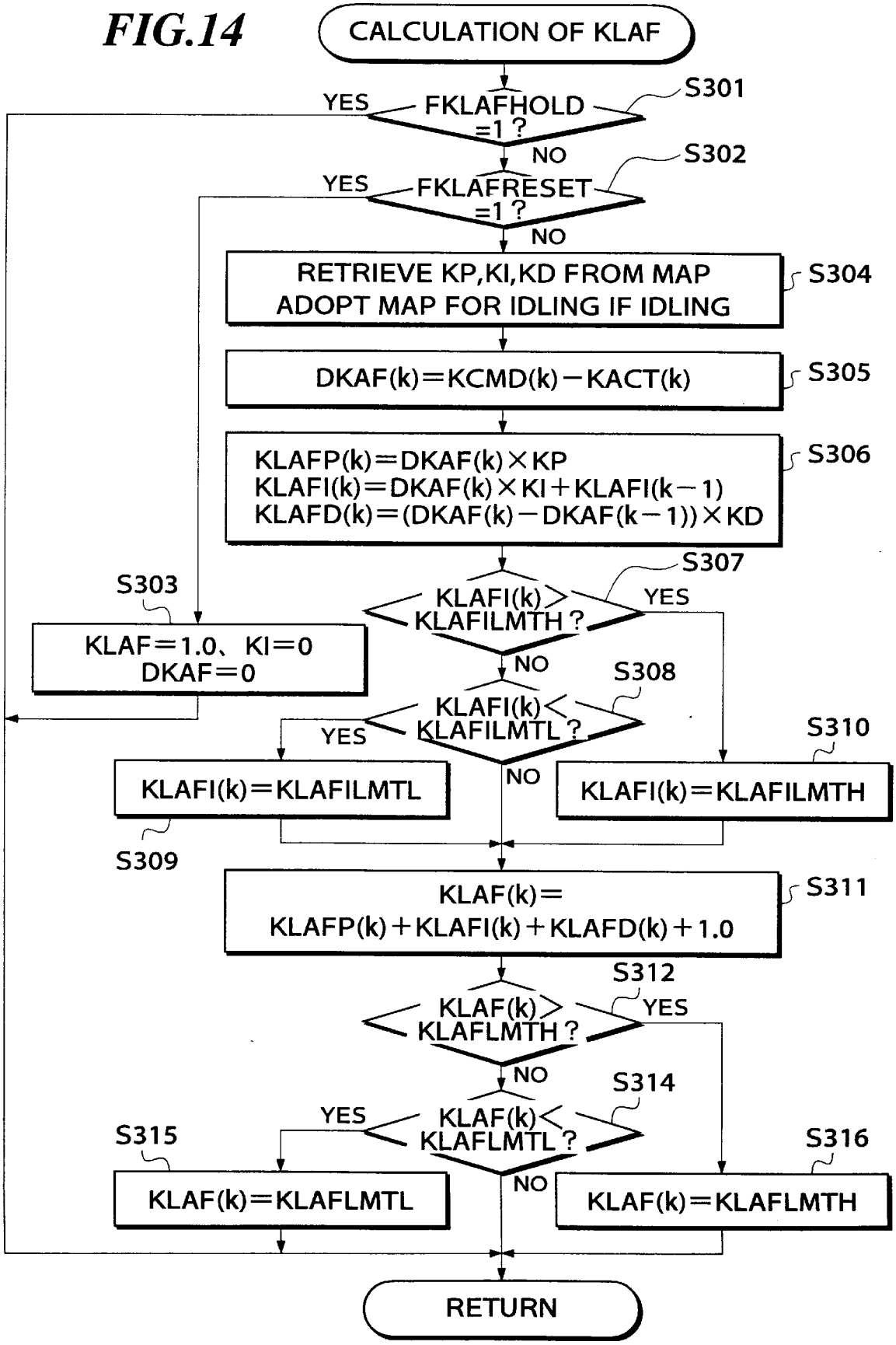
FIG. 14 is a flowchart showing a subroutine for calculating a PID correction coefficient KLAF, which is executed at a step S9 in FIG. 3.

FIG. 14 shows a subroutine for calculating the PID correction coefficient KLAF.

First, at a step S301, it is determined whether or not the hold flag FKLAFHOLD assumes "1". If FKLAFHOLD=1 holds, the present processing is immediately terminated, whereas if FKLAFHOLD=0 holds, it is determined at a step S142 whether or not the KLAF reset flag FKLAFRESET assumes "1". If FKLAFRESET=1 holds, the program proceeds to a step S303, wherein the PID correction coefficient KLAF is set to "1.0" and at the same time an integral term control gain KI and a difference DKAF between the desired equivalent ratio KCMD and the actual equivalent ratio KACT are set to "0", followed by terminating the program.

If FKLAFRESET=0 holds at the step S302, the program proceeds to a step S304, wherein a proportional term control gain KP, the integral term control gain KI and a differential term control gain KD are retrieved from respective maps according to the engine rotational speed NE and the intake pipe absolute pressure PBA. In this connection, during idling of the engine, gain values for the idling condition are adopted. Then, the difference DKAF(k) (=KCMD(k)−KACT(k)) between the desired equivalent ratio KCMD and the actual equivalent ratio KACT is calculated at a step S305, and the difference DKAF(k) and the gains KP, KI, and KD are applied to the following equations (5) to (7) to calculate a proportional term KLAFP(k), an integral term KLAFI(k), and a differential term KLAFD(k) at a step S306:

$$KLAFP(k)=DKAF(k)\times KP \tag{5}$$

$$KLAFI(k)=DKAF(k)\times KI+KLAFI(k-1) \tag{6}$$

$$KLAFD(k)=(DKAF(k)-DKAF(k-1))\times KD \tag{7}$$

At the following steps S307 to S310, limit-checking of the integral term KLAFI(k) is carried out. More specifically, it is determined whether or not the KLAFI(k) value falls within a range defined by predetermined upper and lower limit values KLAFILMTH and KLAFILMTL at steps S307 and S308, respectively. If KLAFI(k)>KLAFILMTH holds, the integral term KLAFI(k) is set to the predetermined upper limit value KLAFILMTH at a step S310, whereas if FLAFI (k)<KLAFILMTL holds, the same is set to the predetermined lower limit value KLAFILMTL at a step S309.

At the following step S311, the PID correction coefficient KLAF(k) is calculated by the use of the following equation (8):

$$KLAF(k)=KLAFP(k)+KLAFI(k)+KLAFD(k)+1.0 \tag{8}$$

Then, it is determined at a step S312 whether or not the KLAF(k) value is larger than a predetermined upper limit value KLAFLMTH. If KLAF(k)>KLAFLMTH holds, the PID correction coefficient KLAF is set to the predetermined upper limit value KLAFLMTH at a step S316, followed by terminating the program.

If KLAF(k)≦KLAFLMTH holds at the step S312, it is determined at a step S314 whether or not the KLAF(k) value is smaller than a predetermined lower limit value KLAFLMTL. If KLAF(k)≧KLAFLMTL holds, the present program is immediately terminated, whereas if KLAF(k) <KLAFLMTL holds, the PID correction coefficient KLAF is set to the predetermined lower limit value KLAFLMTL at a step S315, followed by terminating the program.

By the above subroutine, the PID correction coefficient KLAF is calculated by the PID control such that the actual equivalent ratio KACT becomes equal to the desired equivalent ratio KCMD.

Next, description will be made of calculation of the adaptive control correction coefficient KSTR with reference to FIG. 15.

Figure 15:
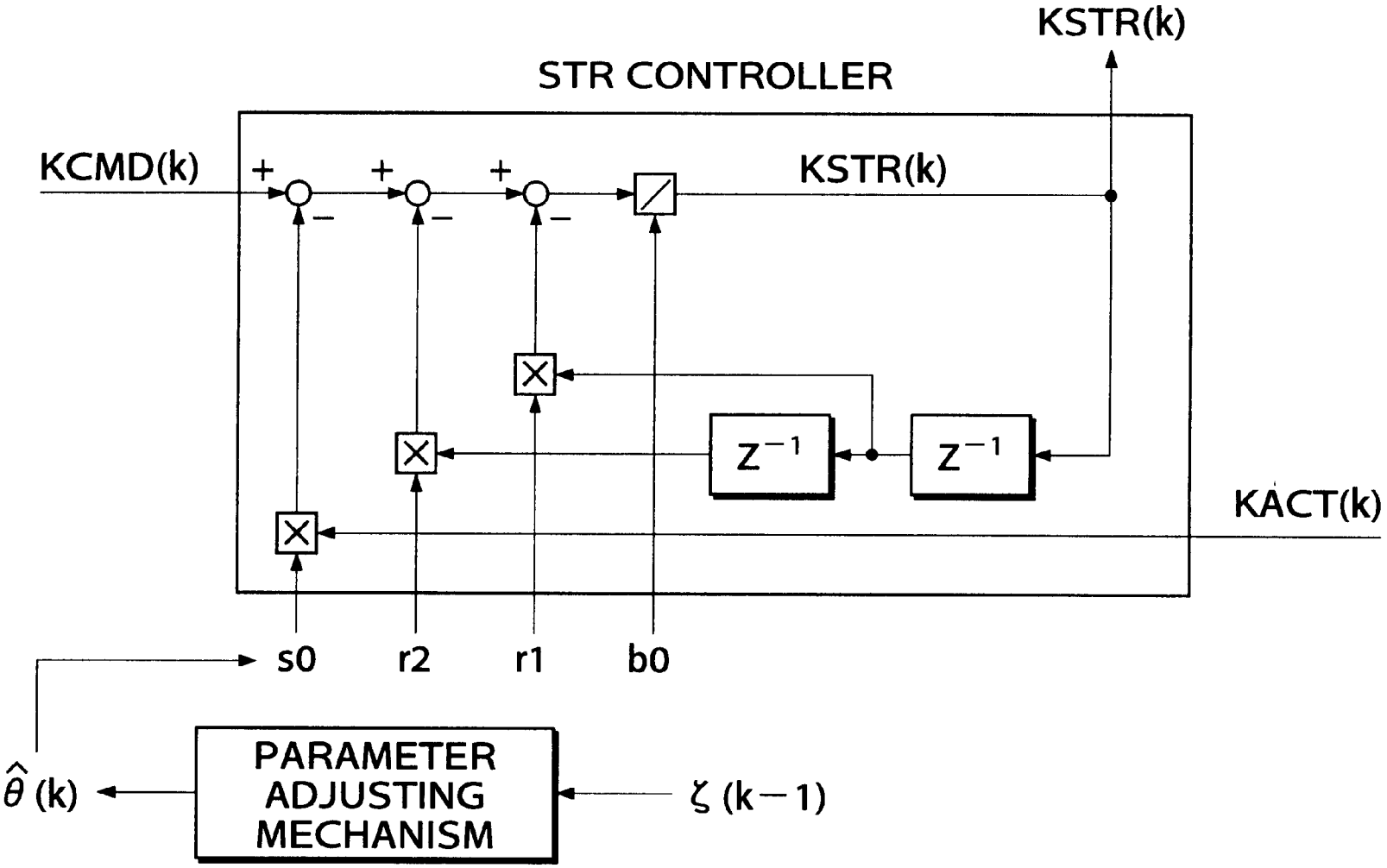
FIG. 15 is a block diagram useful in explaining a manner of calculating an adaptive control correction coefficient KSTR.

FIG. 15 shows the construction of the block B19 in FIG. 2, i.e. the self-tuning regulator (hereinafter referred to as "the STR") block. The STR block is comprised of a STR controller for setting the adaptive control correction coefficient KSTR such that the detected equivalent ratio KACT(k) becomes equal to the desired air-fuel ratio coefficient (desired equivalent ratio) KCMD(k), and a parameter adjusting mechanism for setting parameters to be used by the STR controller.

Adjustment laws (mechanisms) for adaptive control employed in the present embodiment include a parameter adjustment law proposed by Landau et al. According to this parameter adjustment law, the stability of the so-called adaptive system is ensured by converting the so-called adaptive system to an equivalent feedback system formed of a linear block and a non-linear block, and setting the parameter adjustment law such that Popov's integral inequality holds in respect of inputting to and outputting from the non-linear block and at the same time the linear block is "strictly positive real". This method is known and described e.g. in "Computrole" No. 27, CORONA PUBLISHING CO., LTD., Japan, pp. 28–41, "Automatic control handbook" OHM, LTD., Japan, pp. 703–707, "A Survey of Model Reference Adaptive Techniques—Theory and Application", I. D. LANDAU "Automatica" Vol. 10, pp. 353–379, 1974, "Unification of Discrete Time Explicit Model Reference Adaptive Control Designs", I. D. LANDAU et al. "Automatica" Vol. 17, No. 4, pp. 593–611, 1981, and "Combining Model Reference Adaptive Controllers and Stochastic Self-tuning Regulators" I. D. LANDAU "Automatical " Vol. 18, No. 1., pp. 77–84, 1982.

In the present embodiment, the above parameter adjustment law proposed by Landau et al. is employed. This parameter adjustment law will be described in detail, hereinbelow: According to this adjustment law, if polynomials of the denominator and numerator of the transfer function $A(Z^{-1})/B(Z^{-1})$ of the object of control by a discrete system are expressed by the following equations (9) and (10), the adaptive parameter $\hat{\theta}^T(k)$ and the input $\zeta^T(k)$ to the adaptive parameter adjusting mechanism are defined by the following equations (11) and (12). The equations (9) to (12) define an example of a plant in which m=1, n=1 and d=2 hold, i.e. a system of the first order thereof has an ineffective time as long as two control cycles where d=2 cycles as shown by two blocks $z^{-1}$ in FIG. 15. The symbol k used herein indicates that the parameter with (k) has the present value, one with (k−1) the immediately preceding value, and so forth. u(k) and y(k) correspond to the KSTR(k) and KACT (k) values, respectively, in the present embodiment.

$$A(z^{-1}) = 1 + a_1 z^{-1} + \ldots + a_n z^{-n} \tag{9}$$

$$B(z^{-1}) = b_0 + b_1 z^{-1} + \ldots + b_m z^{-m} \tag{10}$$

$$\begin{aligned}\hat{\theta}^T(k) &= [b_0(k), r_1(k), \ldots r_{m+d-1}(k), S_0(k), \ldots, S_{n-1}(k)] \\ &= [b_0(k), r_1(k), r_2(k), r_3(k), s_0(k)]\end{aligned} \tag{11}$$

$$\begin{aligned}\zeta^T(k) &= [u(k), \ldots, u(k-m-d+1), y(k), \ldots, y(k-n+1)] \\ &= [u(k), u(k-1), u(k-2), u(k-3), y(k)]\end{aligned} \tag{12}$$

The adaptive parameter $\hat{\theta}(k)$ is expressed by the following equation (13):

$$\hat{\theta}(k)=\hat{\theta}k-1)+\Gamma(k-1)\zeta(k-d)e^*(k) \tag{13}$$

where the symbols Γ(k) and e*(k) represent a gain matrix and an identification error signal, respectively, and can be expressed by the following recurrence formulas (14) and (15):

$$\Gamma(k) = \frac{1}{\lambda_1(k)}\left[\Gamma(k-1) - \frac{\lambda_2(k)\Gamma(k-1)\zeta(k-d)\zeta^T(k-d)\Gamma(k-1)}{\lambda_1(k) + \lambda_2(k)\zeta^T(k-d)\Gamma(k-1)\zeta(k-d)}\right] \tag{14}$$

$$e^*(k) = \frac{D(z^{-1})y(k) - \hat{\theta}^T(k-1)\zeta(k-d)}{1 + \zeta^T(k-d)\Gamma(k-1)\zeta(k-d)} \tag{15}$$

Further, it is possible to provide various specific algorithms depending upon set values of λ1(k) and λ2(k). For example, if λ1(k)=1 and λ2(k)=λ(0<λ1<2), a progressively decreasing gain algorithm is provided (if λ=1, the least square method), if λ1(k)=λ1 (0<λ1<1) and λ2(k)=λ2 (0<λ2<2), a variable gain algorithm (if λ2=1, the method of weighted least squares), and if λ1(k)/λ2(k)=λ and if λ3 is expressed by the following equation (16), λ1(k)=λ3 provides a fixed trace algorithm. Further, if λ1(k)=1 and λ2(k)=0, a fixed gain algorithm is obtained. In this case, as is clear from the equation (14), Γ(k)=Γ(k−1), and hence Γ(k)=Γ (fixed value) is obtained.

$$\lambda_3(k) = 1 - \frac{\|\Gamma(k-1)\zeta(k-d)\|^2}{\sigma + \zeta^T(k-d)\Gamma(k-1)\zeta(k-d)} \cdot \frac{1}{tr\Gamma(0)} \tag{16}$$

In the example of FIG. 15, the STR controller (adaptive controller) and the adaptive parameter adjusting mechanism are arranged outside the fuel injection amount-calculating system, and operate to calculate the feedback correction coefficient KSTR(k) such that the actual air-fuel ratio KACT (k) becomes equal to the desired air-fuel ratio coefficient KCMD(k−d') (d' represents the above-mentioned ineffective time period before the KCMD value reflects on the actual air-fuel ratio KACT) in an adaptive manner.

In this manner, the adaptive control correction coefficient KSTR(k) and the actual equivalent ratio KACT(k) are determined, which are input to the adaptive parameter-adjusting mechanism, where the adaptive parameter $\hat{\theta}(k)$ is calculated to be input to the STR controller. The STR controller is also supplied with the desired equivalent ratio coefficient KCMD(k) and calculates the adaptive control correction coefficient KSTR(k) such that the actual equivalent ratio KACT(k) becomes equal to the desired equivalent ratio coefficient KCMD(k), by the use of the following recurrence formula (17):

$$KSTR(k) = \frac{KCMD(k-d') - s_0 \times KACT(k) - r_1 \times KSTR(k-1) - r_2 \times KSTR(k-2)}{b_0} \tag{17}$$

Figure 16:
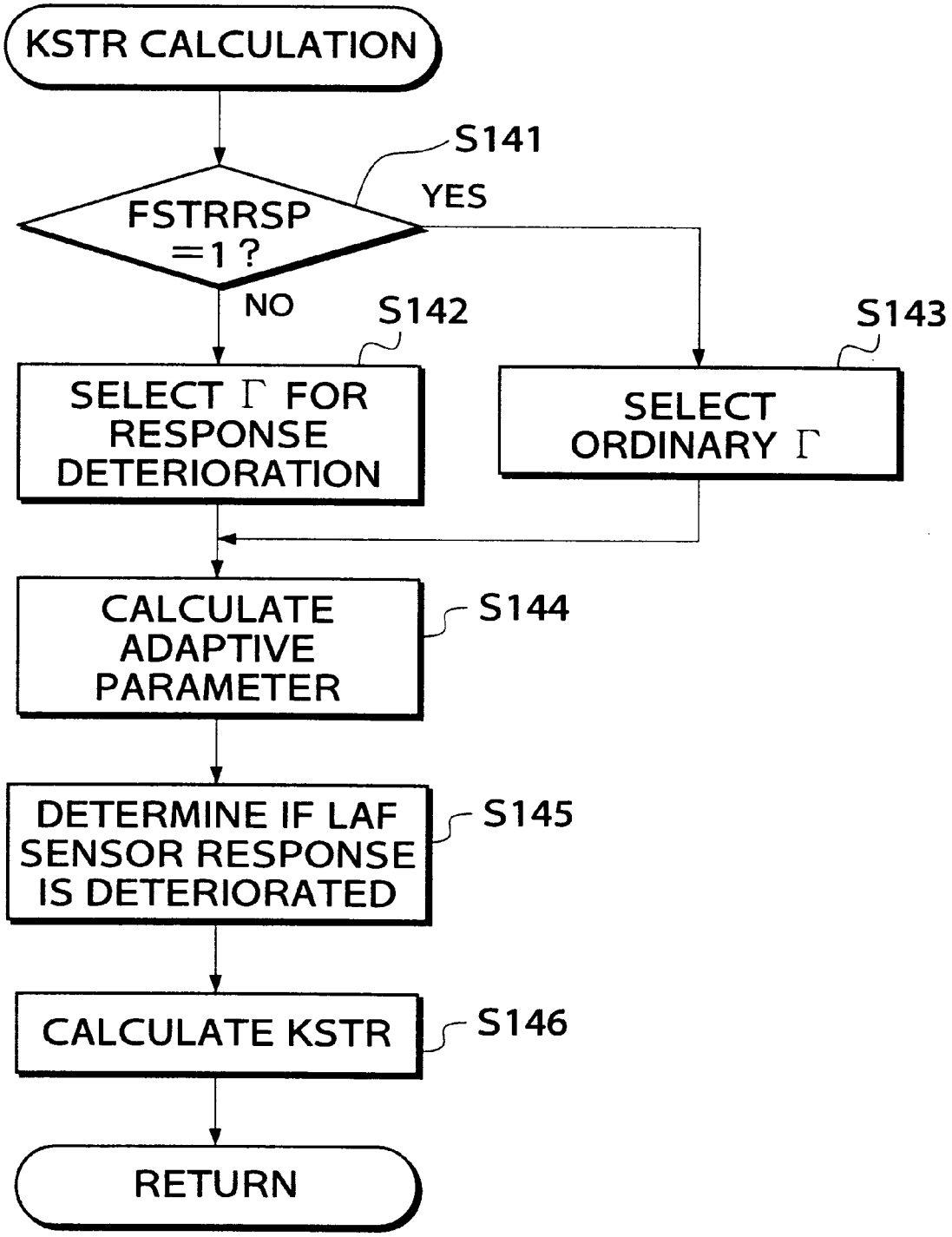
FIG. 16 is a flowchart showing a subroutine for calculating the KSTR value, which is executed at the step S9 in FIG. 3.

FIG. 16 shows a subroutine for calculating the adaptive control correction coefficient KSTR in the above described manner. In the present embodiment, the fixed gain algorithm is used, which is obtained by setting λ1=1 and λ2=0. By this setting, the gain matrix Γ is fixed, which is expressed by the following formula (18):

$$\Gamma = \begin{bmatrix} G11 & 0 & 0 & 0 \\ 0 & G22 & 0 & 0 \\ 0 & 0 & G33 & 0 \\ 0 & 0 & 0 & G44 \end{bmatrix} \tag{18}$$

First, at a step S141, it is determined whether or not a response deterioration flag FSTRRSP, which is set to "0" to indicate that the response characteristic of the LAF sensor 17 is deteriorated (the response delay has increased), is set to "1". If FSTRRSP=1 holds, which means that the response characteristic is not deteriorated, an ordinary gain matrix Γ is selected at a step S143, followed by the program proceeding to a step S144. On the other hand, if FSTRRSP=0 holds, which means that the response characteristic is deteriorated, a gain matrix Γ for response deterioration is selected at a step S142, followed by the program proceeding to the step S144. The gain matrix Γ for response deterioration is set such that values of component elements of the matrix are set to smaller values than those of the ordinary gain matrix Γ. More specifically, according to the present embodiment, the gain matrix Γ is a square matrix, as indicated by the equation (18), where the component elements except for the diagonal elements are all zero, and therefore the diagonal elements G11 to G44 for response deterioration are set to smaller values than those of the ordinary gain matrix.

Thus, when the LAF sensor is deteriorated in response characteristic, the gain matrix having smaller gains than those of the ordinary matrix is employed.

Therefore, the adaptive speed of the parameter adjusting mechanism, i.e. the adjusting speed of the adaptive parameters is degraded, to thereby ensure required stability of the adaptive control even when the LAF sensor has some response delay.

At the step S144, the adaptive parameter ($\hat{\theta}(k)$) is calculated, as mentioned above, and then a determination as to LAF sensor response deterioration and a calculation of the adaptive control correction coefficient KSTR by the use of the above equation (17) are executed at steps S145 and S146, respectively, followed by terminating the present routine.

Figure 17:
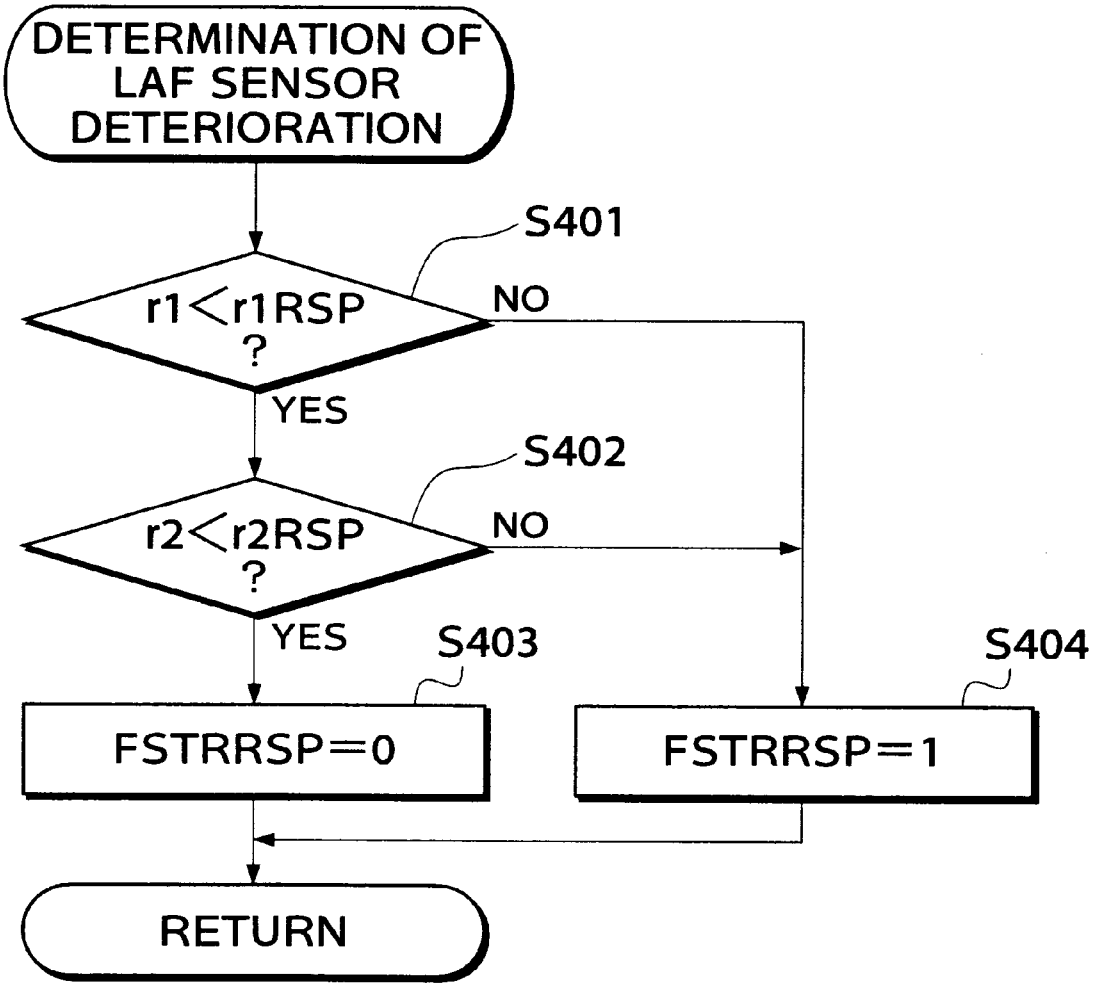
FIG. 17 is a flowchart showing a subroutine for executing a LAF sensor response deterioration-determination, which is executed at a step S145 in FIG. 16.

FIG. 17 shows a subroutine for executing the determination as to LAF sensor response deterioration, which is executed at the step S145 in FIG. 16. At a step S401, it is determined whether or not the adaptive parameter r1 is smaller than a predetermined value r1RSP, and if r1<r1RSP holds, it is further determined at a step S402 whether or not the adaptive parameter r2 is smaller than a predetermined value r2RSP. If the answer to the question of the step S401 or S402 is negative (NO), it is determined that the response characteristic of the LAF sensor 17 is not deteriorated, and then the response deterioration flag FSTRRSP is set to "1" at a step S404. On the other hand, if the answers to the questions of the steps S401 and S402 are both affirmative (YES), it is determined that the response characteristic is deteriorated, and then the flag FSTRRSP is set to "0" at a step S403, followed by terminating the present routine.

The adaptive parameters r1 and r2 determine the responsiveness of the parameter adjusting mechanism, and if the response characteristic of the LAF sensor 17 is deteriorated, the values of the parameters r1 and r2 are decreased. Therefore, whether the response characteristic of the LAF sensor is deteriorated can be determined based on the result of a comparison between these adaptive parameter values and the respective predetermined values.

Next, a manner of calculation of the feedback correction coefficient KFB by switching between the PID correction coefficient KLAF and the adaptive control correction coefficient KSTR, i.e. by switching between the PID control and the adaptive control.

Figure 18:
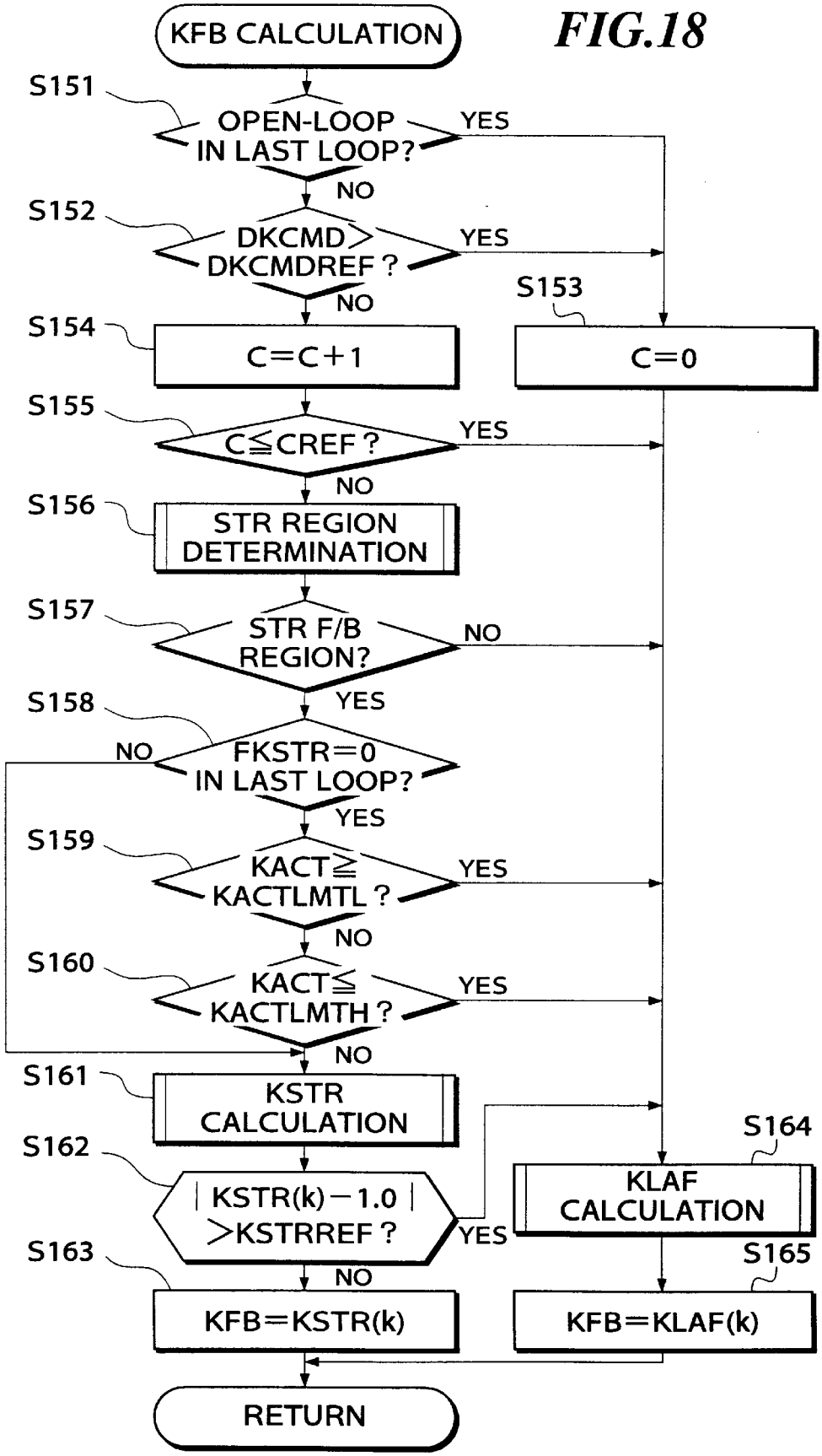
FIG. 18 is a flowchart showing a subroutine for calculating a feedback correction coefficient KFB, which is executed at the step S9 in FIG. 3.

FIG. 18 shows a subroutine for calculating the feedback correction coefficient KFB executed at the step S9 in FIG. 3.

First, it is determined at a step S151 whether or not the control mode was an open-loop control mode in the last loop of execution of the FIG. 3 routine, i.e. if FKLAFRESET=1 holds. If the control mode was not the open-loop control mode, it is determined at a step S152 whether or not a rate of variation DKCMD in the desired equivalent ratio KCMD (=|KCMD(k)−KCMD(k−1|) is larger than a reference value DKCMDREF. If the control mode was the open-loop control mode in the last loop of execution of the FIG. 3 routine, or if the control mode was the feedback control in-the last loop of execution of the FIG. 3 routine and at the same time the rate of variation DKCMD is larger than the reference value DKCMDREF, it is determined that the engine is in a region where the feedback control based on the PID correction coefficient KLAF should be executed (hereinafter referred to as "the PID control region"). Then, a counter C is reset to "0" at a step S153, followed by the program proceeding to a step S164. At the step S164, a PID correction coefficient KLAF calculation is executed, which will now be described with reference to FIG. 20A.

Figure 20A:
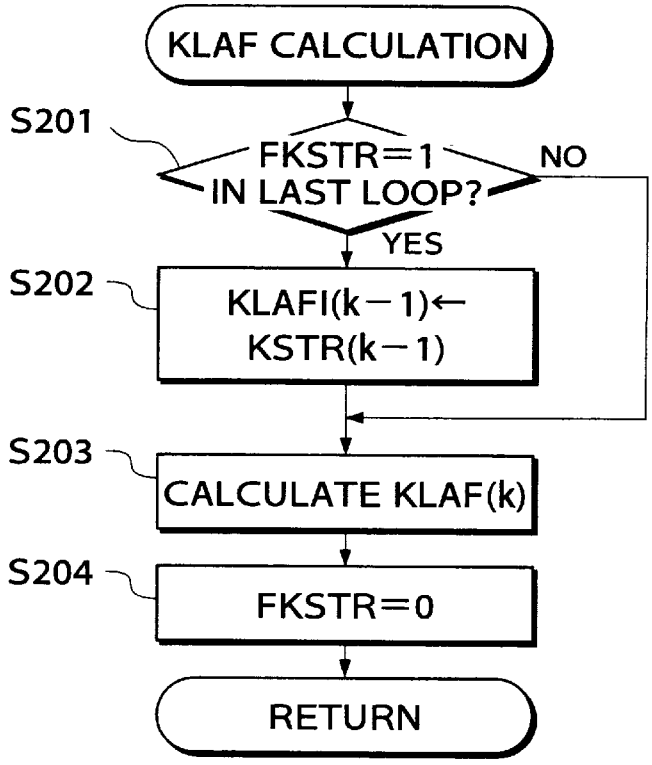
FIG. 20A is a flowchart showing a subroutine for calculating the PID correction coefficient KLAF, which is executed at a step S164 in FIG. 18.

At a step S201 in FIG. 20A, it is determined whether or not a STR flag FKSTR assumed "1" in the last loop of execution of the FIG. 20A routine. The STR flag FKSTR, when set to "1", indicates that the engine is in a region where the feedback control based on the adaptive control correction coefficient KSTR should be executed (hereinafter referred to as "the adaptive control region"). This flag FKSTR is set after the calculation of the feedback control correction coefficient KFB (at a step S204 in FIG. 20A and a step S213 in FIG. 20B).

If FKSTR=0 held in the last loop, the program jumps to a step S203. On the other hand, if FKSTR=1 held in the last loop, the program proceeds to a step S202, wherein the last value KALFI(k−1) of the integral term of the PID control is set to the last value of the adaptive control correction coefficient KSTR(k−1), followed by the program proceeding to the step S203. At the step S203, the PID correction coefficient KLAF is calculated by the aforedescribed processing of FIG. 14, and then the STR flag FKSTR is set to "0" at the step S204, followed by terminating the present routine.

When the adaptive control is switched to the PID control (if the flag FKSTR was set to "1" in the last loop), the integral term KLAFI of the PID control can be suddenly changed, and therefore the KLAFI(k−1) value is set to the KSTR(k−1) value at the step S202. By virtue of this setting, the difference between the adaptive control correction coefficient KSTR(k−1) and the PID correction coefficient KLAF (k) can be kept small, to thereby enable smooth switching from the adaptive control to the PID control and hence ensure required stability of the air-fuel ratio feedback control.

Referring again to the FIG. 18 program, at a step S165, the feedback correction coefficient KFB is set to the PID correction coefficient KLAF(k) calculated at the step S164, followed by terminating the present routine.

The reason why the PID control should be executed when the control mode was the open-loop control mode in the last loop is as follows: For example, when the engine operating condition has just returned from a fuel cut mode to the feedback control mode, the detected air-fuel ratio do not always indicate the actual value of the air-fuel ratio due to the response lag of the LAF sensor, which can result in unstable control of the air-fuel ratio if the adaptive control is executed. For a similar reason to the above, it is also determined that the PID control should be executed when the rate of variation DKCMD in the desired equivalent ratio KCMD is large, for example, when the engine operating condition has just returned from a throttle valve fully open state to an ordinary load condition, or when the engine operating condition has just returned from the lean-burn control to the stoichiometric air-fuel ratio control.

If the answers to the questions of the steps S151 and S152 are both negative (NO), i.e. if the control mode was the feedback control mode in the last loop and at the same time the rate of variation DKCMD in the desired equivalent ratio KCMD is lower than the reference value DKCMDREF, the count value of the counter C is incremented by "1" at a step S154, and then the count value of the counter C is compared with a predetermined value CREF (e.g. 5) at a step S155. If the count value is smaller than the CREF value, the program proceeds to the step S164.

The reason why the PID control should be executed when the count value of the counter C is smaller than the reference value CREF is as follows: Immediately after returning of the engine operating condition from the open-loop control or immediately after a large variation in the desired equivalent ratio KCMD, a time lag before completion of fuel combustion, and a response lag of the LAF sensor are so large that influences thereof cannot be compensated for by the adaptive control.

Figure 19:
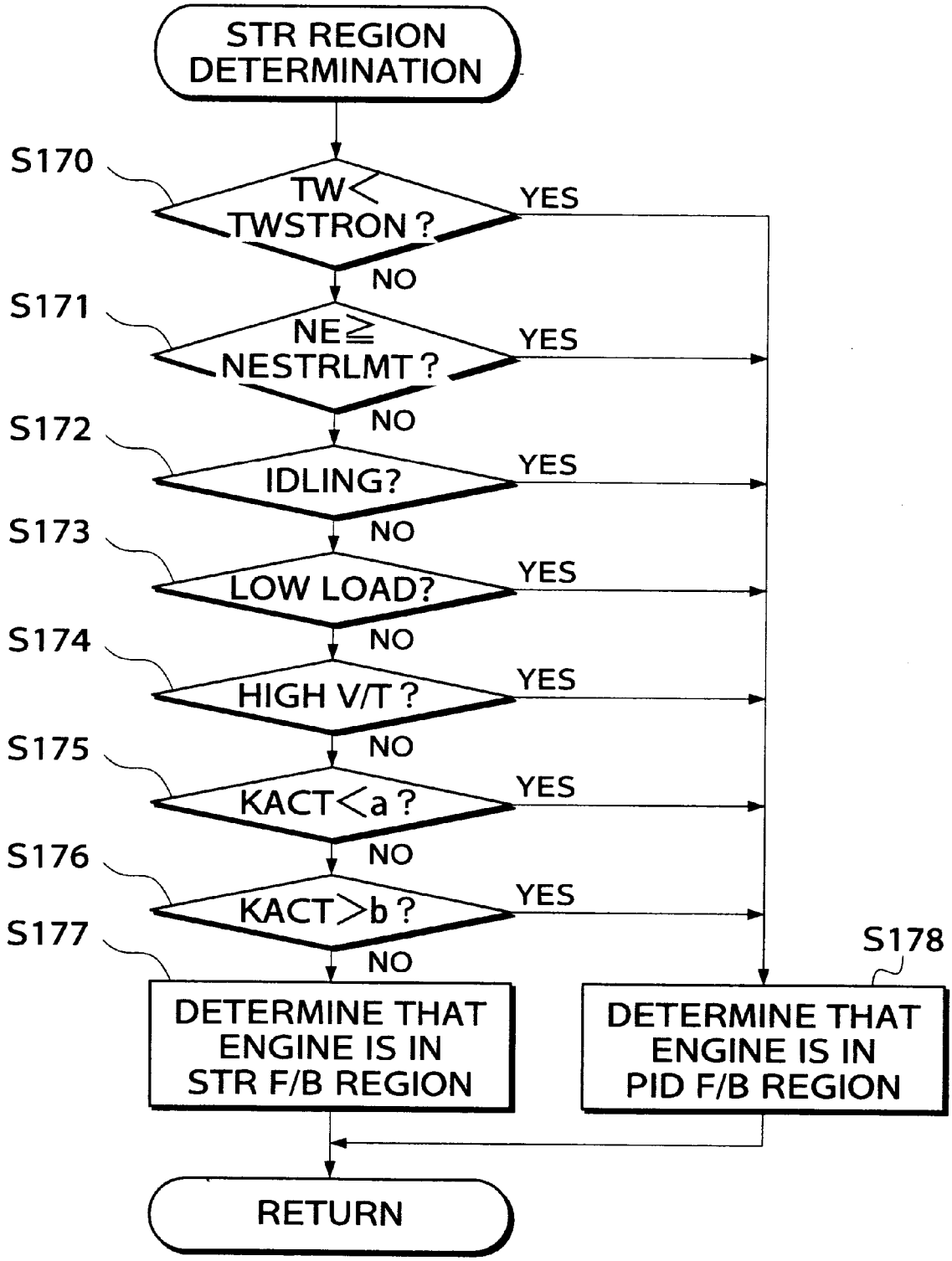
FIG. 19 is a flowchart showing a subroutine for determining an adaptive control region, which is executed at a step S156 in FIG. 18.

Then, at a step S156, a determination as to the adaptive control region should be executed is carried out, which will now be described with reference to FIG. 19 showing a subroutine for executing the determination. The subroutine of FIG. 19 determines whether the feedback correction coefficient KFB should be obtained by the adaptive control or by the PID control, based on the present operating condition of the engine.

First, it is determined at a step S170 whether or not the engine coolant temperature TW is lower than a predetermined value TWSTRON. If TW≧TWSTRON holds, it is determined at a step S171 whether or not the engine rotational speed NE is higher than a predetermined value NESTRLMT. If NE<NESTRLMT holds, it is determined at a step S172 whether or not the engine is idling. If the engine is not idling, it is determined at a step S173 whether or not the intake pipe absolute pressure PBA is lower than a predetermined value, i.e. the engine is in a low load condition. If the engine is not in a low load condition, it is determined at a step S174 whether or not the valve timing of the engine is set to the high-speed valve timing. If the valve timing is not set to the high-speed valve timing, it is determined at a step S175 whether or not the detected equivalent ratio KACT is smaller than a predetermined value a. If the KACT value is not smaller than the predetermined value a, it is determined at a step S176 whether or not the KACT value is larger than a predetermined value b (>a).

If any of the answers to the questions of the steps S170 to S176 is affirmative (YES), it is determined at a step S178 that the PID control should be executed, followed by terminating the present routine.

The reason why it is thus determined that the PID control should be executed and the feedback correction coefficient KFB is calculated by the PID control is as follows: When the engine coolant temperature TW is low (TW>TWSTRON), the engine combustion is not stable, so that a misfire can occur. Therefore, a stable value of the detected equivalent ratio KACT cannot be obtained if the adaptive control is carried out on such an occasion. Also when the engine coolant temperature TW is extremely high, the feedback correction coefficient KFB is calculated by the PID control for a similar reason to the above. When the engine rotational speed NE is high, i.e. if NE≧NESTRLMT holds, the ECU 5 can have an insufficient calculation time and further the engine combustion is not stable. When the high-speed valve timing is selected, an overlap time period over which the intake valves and the exhaust valves are both open is prolonged so that blowing of the mixture through the open exhaust valves without being burned within the combustion chamber can occur, and accordingly a stable value-of the detected equivalent ratio KACT cannot be obtained if the adaptive control is carried out. Further, when the engine is idling, the engine operating condition is almost stable, and therefore the adaptive control, which is a high gain control, is not required.

Further, if the detected equivalent ratio KACT is smaller than the predetermined value a or larger than the predetermined value b, which means that the air-fuel ratio of the mixture supplied to the engine is lean or rich, and therefore the high-gain adaptive control should not be executed. The determinations at the steps S175 and S176 may employ the desired equivalent ratio KCMD instead of the detected equivalent ratio KACT.

On the other hand, if the answers to the questions of the steps S170 to S176 are all negative (NO), it is determined at a step S177 that the adaptive control should be executed, followed by terminating the present routine.

Referring again to FIG. 18, at a step S157, it is determined whether or not the feedback correction coefficient KFB should be calculated by the adaptive control, depending on the result of the determination by the FIG. 19 subroutine. If the answer to the question of the step S157 is negative (NO), the program proceeds to the step S164, whereas if the answer to the question of the step S157 is affirmative (YES), the program proceeds to a step S158, wherein it is determined whether or not the STR flag FKSTR assumed "0" in the last loop.

If FKSTR=1 held in the last loop, the program jumps to a step S161, whereas if FKSTR=0 held in the last loop, it is determined at steps S159 and S160 whether or not the detected equivalent ratio KACT falls within a range between a predetermined upper limit value KACTLMTH (e.g. 1.01) and a predetermined lower limit value KACTLMTL (e.g. 0.99). If KACT<KACTLMTL or KACT>KACTLMTH holds, the program proceeds to the step S164, wherein the PID correction coefficient KLAF is calculated. On the other hand, if KACTLMTL≦KACT≦KACTLMTH holds, the program proceeds to the step S161, wherein a KSTR calculation is executed, which will be described hereinbelow with reference to FIG. 20B showing a subroutine for calculating the adaptive correction coefficient KSTR.

By executing the steps S158 to S160, changeover of the feedback control of the engine from the PID control to the adaptive control is carried out when it is determined that the adaptive control should be executed and at the same time the detected equivalent ratio KACT assumes 1.0 or a value close thereto. Thus, smooth changeover of the feedback control from the PID control to the adaptive control can be carried out, to thereby ensure required stability of the engine control.

Figure 20B:
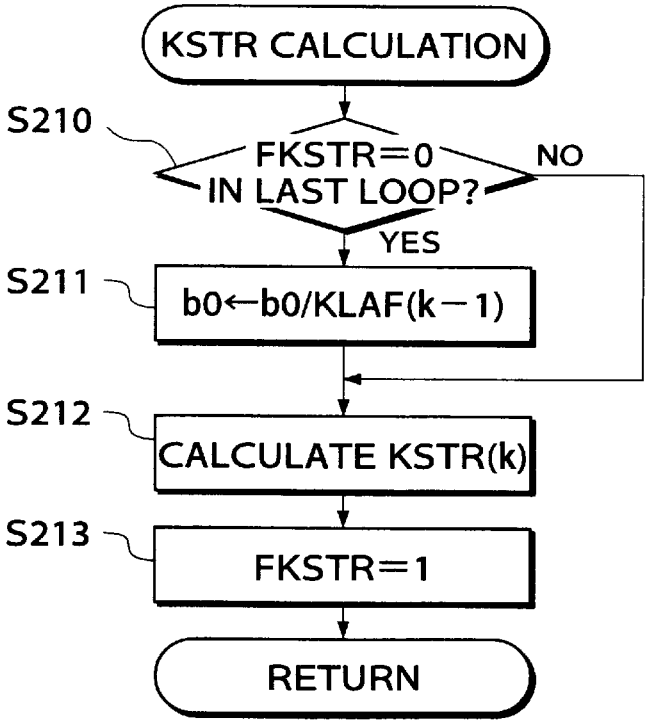
FIG. 20B is a flowchart showing a subroutine for calculating the adaptive control correction coefficient KSTR, which is executed at a step S161 in FIG. 18.

At a step S210 in FIG. 20B, it is determined whether or not the flag FKSTR assumed "0" in the last loop. If the flag KSTR assumed "1" in the last loop, the program jumps to a step S212, wherein the adaptive control correction coefficient KSTR is calculated in the manner described hereinbefore, and then the flag FKSTR is set to "1" at a step S213, followed by terminating the present routine.

On the other hand, if the flag FKSTR assumed "0" in the last loop, the adaptive parameter b0 (scalar quantity determining the gain) is replaced by a value obtained by dividing the b0 value by the last value KLAF(k−1) of the PID correction coefficient KLAF at a step S211, followed by the program proceeding to the step S212.

By replacing the adaptive parameter b0 by the value b0/KLAF(k−1) at the step S211, further smooth changeover from the PID control to the adaptive control can be obtained to thereby ensure required stability of the control. The reason for the replacement is as follows: If the value b0 in the equation (17) is replaced by the value b0/KLAF(k−1), the following equation (19) is obtained, where the first term of the first equation is equal to "1" because the adaptive correction coefficient is set to and held at 1 (KSTR(k)=1) during execution of the PID control. Accordingly, the value KSTR(k) at the start of the adaptive control becomes equal to the value KLAF(k−1), resulting in smooth changeover of the correction coefficients:

$$KSTR(k) = \left[ \frac{KCMD(k-d') - s_0 \times KACT(k) - r_1 \times KSTR(k-1) - r_2 \times KSTR(k-2)}{b_0} \right] \times KLAF(k-1) \quad (19)$$

-continued $$= 1 \times KLAF(k-1)$$

$$= KLAF(k-1)$$

Referring again to the FIG. 18 program, it is determined at a step S162 whether or not the absolute value of the difference between the value of the adaptive control correction coefficient KSTR obtained at the step S161 and a value of 1.0, i.e. |KSTR(k)−1.0| is larger than a reference value KSTRREF. If |KSTR(k)−1.0|>KSTRREF holds, the program proceeds to the step S164, whereas if |KSTR(k)−1.0|≦KSTRREF holds, the feedback correction coefficient FKB is set to the KSTR(k) value at a step S163, followed by terminating the present routine.

By thus determining that the PID control should be carried out when the absolute value of the difference between the adaptive control correction coefficient KSTR and 1.0 is larger than the reference value KSTRREF, required stability of the air-fuel ratio control can be ensured.

Next, description will be made of a second embodiment of the invention. In the first embodiment described above, deterioration of the response characteristic of the LAF sensor 17 is determined in the manner shown in FIG. 17. According to the present embodiment, however, deterioration of the response characteristic of the LAF sensor 17 is determined in a different manner described below. Except for this, the second embodiment is identical with the first embodiment.

Figure 21A:
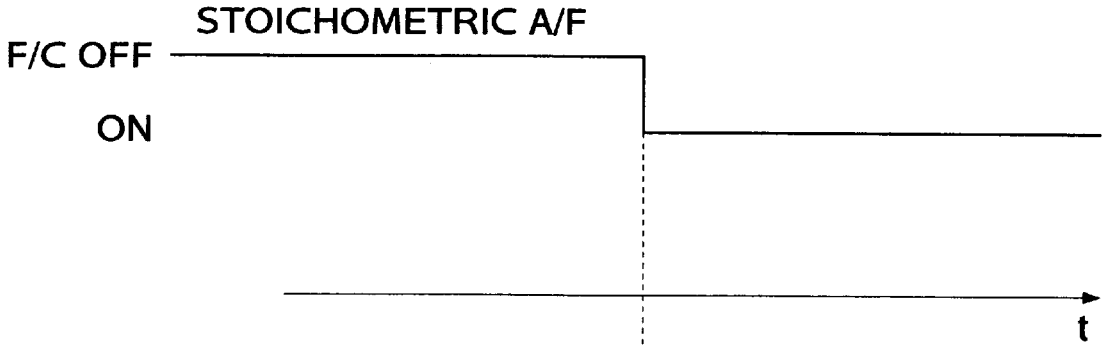
Figure 21B:
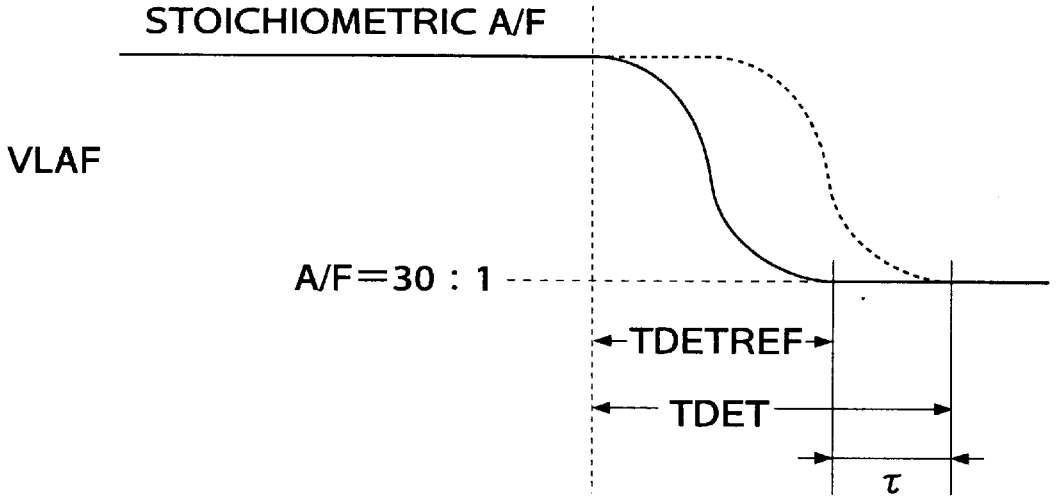

As shown in FIG. 21, according to the present embodiment, first the engine condition is forcibly changed from a condition where the air-fuel ratio is controlled to the stoichiometric air-fuel ratio to a fuel-cut state, and then a detecting time period TDET from the time the fuel-cut is started to the time the LAF sensor output shows an air-fuel ratio A/F of 30 is empirically determined in advance by the use of a LAF sensor functioning normally. The determined detecting time period TDET is set to a reference time TDETREF. In actual operation of the engine, a value of the detecting time period TDET is measured, which is obtained when a change occurs from a condition where the air-fuel ratio is controlled to the stoichiometric air-fuel ratio to a fuel-cut state, and a difference time τ(=TDET−TDETREF) between the measured value of the detecting time period TDET and the reference time period TDETREF is determined. The difference time τ becomes longer as the response characteristic of the LAF sensor is deteriorated. Therefore, the response characteristic of the LAF sensor can be determined from the difference time τ.

More specifically, according to the present embodiment, when the difference time τ is smaller than a predetermined time period τREF, the response deterioration flag FSTRRSP is set to "1", whereas when the difference time τ exceeds the predetermined time period τREF, the response deterioration flag FSTRRSP is set to "0".

According to the present embodiment, the deterioration degree of the response characteristic of the LAF sensor can be detected based on the difference time τ.

Next, description will be made of a third embodiment of the invention. According to the first and second embodiments, if deterioration of the response characteristic of the LAF sensor 17 is detected, i.e. if FSTRRSP=0 holds, a fail-safe action is taken in which the gain matrix Γ for calculating the adaptive control correction coefficient KSTR is replaced by the gain matrix Γ for response deterioration. In the present embodiment, however, in place of the fail-safe action, or in addition to the same, a LAF sensor output selection which is different from that in the first embodiment is carried out as a fail-safe action, such that an output value from the LAF sensor sampled at later sampling timing than that for a normal LAF sensor is selected.

Figure 22:
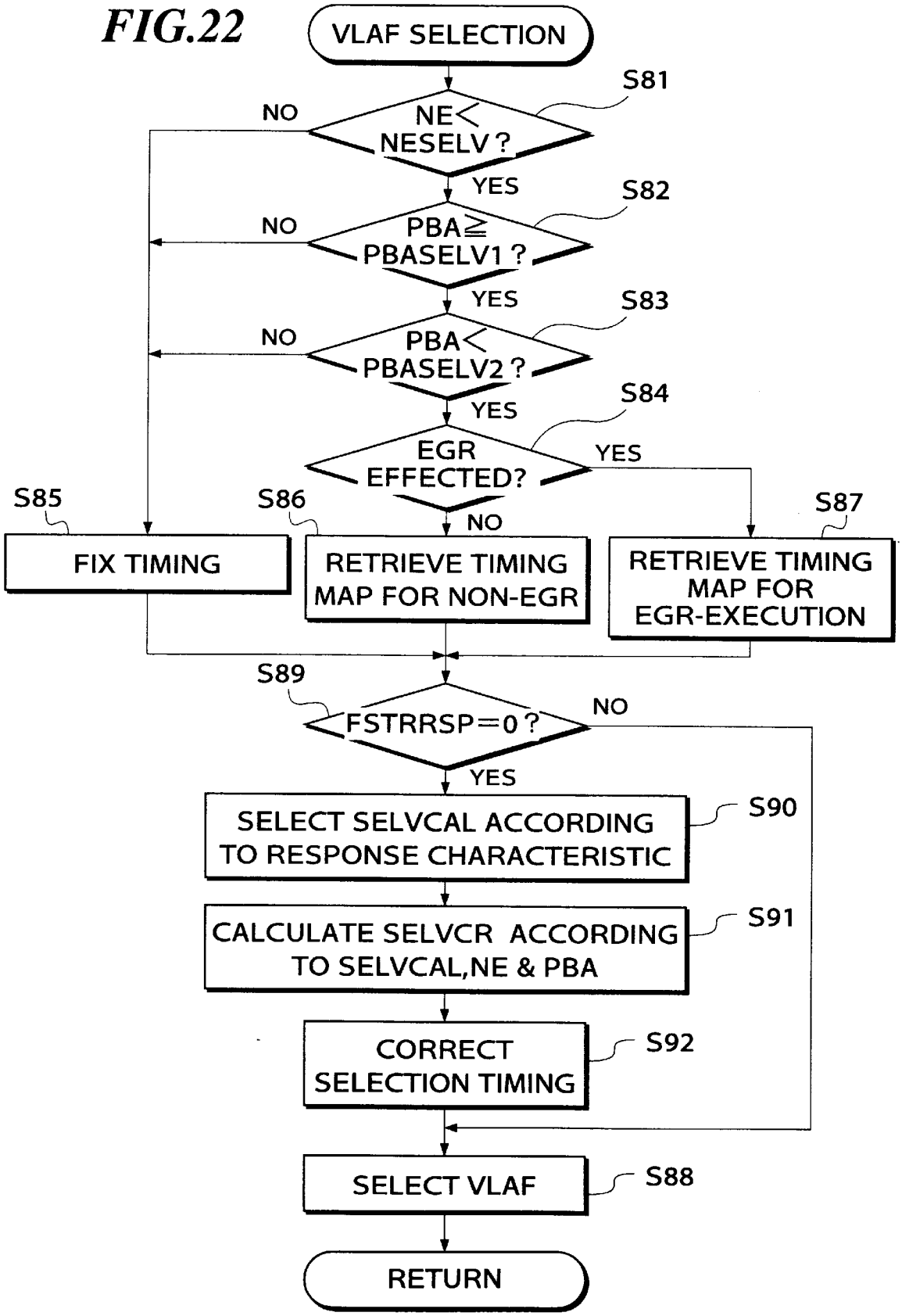
FIG. 22 is a flowchart showing a subroutine for executing a LAF sensor output selection, according to a third embodiment of the invention.

More specifically, in the present embodiment, a subroutine for calculating the KSTR value is executed, which is similar to the FIG. 16 subroutine but different therefrom in that the steps S141 to S143 are omitted, or the FIG. 16 subroutine is employed as it is. Further, in place of the FIG. 9 routine for selecting the LAF sensor output, a subroutine shown in FIG. 22 is executed. Except for this, the third embodiment is identical with the second embodiment.

In the FIG. 22 subroutine, the steps S81 to S88 are identical with those in FIG. 9, description of which is therefore omitted.

Figure 23:
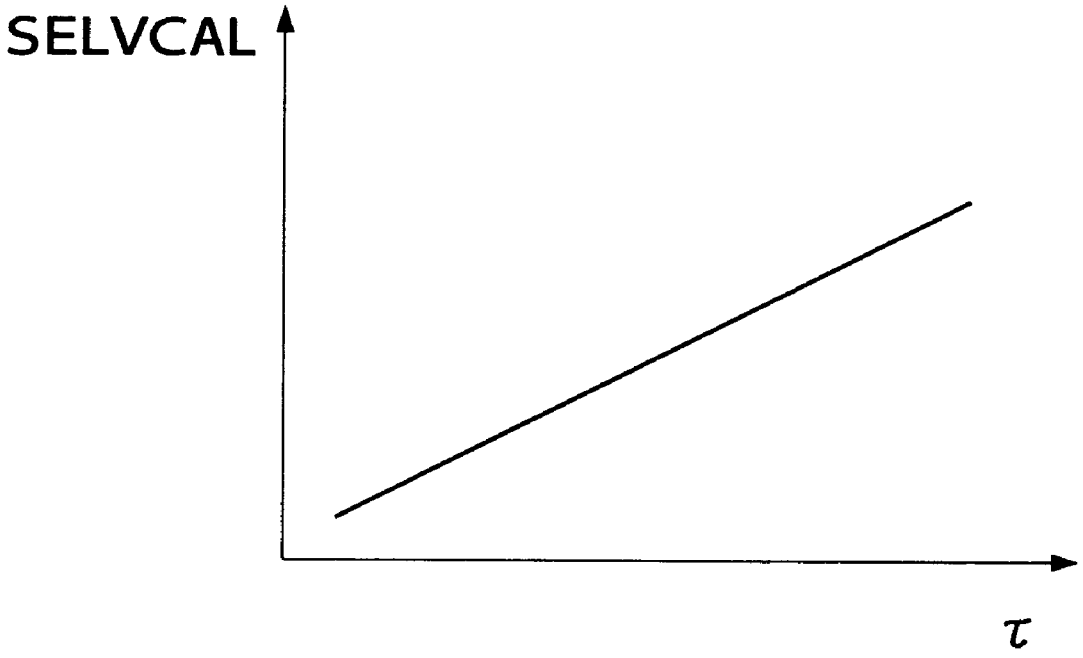
FIG. 23 shows a table for determining a variable SELVCAL according to the degree of deterioration of the response characteristic of the LAF sensor, according to the degree of the third embodiment.

At a step S89 in FIG. 22, it is determined whether or not the response deterioration flag FSTRRSP is set to "0". If FSTRRSP=1 holds, i.e. if deterioration of the response characteristic is not detected, the program jumps to the step S88. On the other hand, if FSTRRSP=0 holds, i.e. if deterioration of the response characteristic is detected, a variable SELVCAL is determined from a table which is set as shown in FIG. 23, according to the response characteristic of the LAF sensor 17, i.e. the difference time τ, at a step S90. Then, a correction amount SELVCR is determined according to the thus determined variable SELVCAL as well as the engine rotational speed NE and the intake pipe absolute pressure PBA at a step S91. More specifically, a plurality of SELVCR maps which are set according to the engine rotational speed NE and the intake pipe absolute pressure PBA are stored in the ROM of the ECU 5, and one of the SELVCR maps is selected based on the SELVCAL value, and the thus selected map is retrieved according to the engine rotational speed NE and the intake pipe absolute pressure PBA to determine the correction amount SELVCR.

Then, the selection timing determined at the steps S85 to S87 is corrected to a value of later timing by the correction amount SELVCR at a step S92, followed by the program proceeding to the step S88.

According to the present embodiment, a more suitable LAF sensor output value can be selected according to the deterioration degree of the response characteristic of the LAF sensor, to thereby ensure required stability of the adaptive control.

Next, description will be made of a fourth embodiment of the invention. According to the present embodiment, when deterioration of the response characteristic of the LAF sensor is detected, in place of changing the gain matrix Γ in the first and second embodiments, another fail-safe action is carried out, which delays the calculation timing of the adaptive control correction coefficient KSTR by a time period corresponding to a time interval of generation of adjacent TDC signal pulses. Except for this, the processing in the fourth embodiment is identical with that in the first and second embodiments.

More specifically, the adaptive control correction coefficient KSTR to be used in calculation of the fuel amount supplied to the #N cylinder (N=1 to 4) is usually calculated immediately after the start of the explosion stroke of the #N cylinder. When deterioration of the response characteristic of the LAF sensor-is detected, however, the calculation of the correction coefficient KSTR is carried out immediately after the start of the exhaust stroke of the cylinder.

This prevents instability of the adaptive control due to deterioration of the response characteristic of the LAF sensor. This fail-safe action is especially effective when the response delay of the LAF sensor is so large that the change of the LAF sensor output selection timing according to the third embodiment cannot cope with the response delay.

Figure 26:
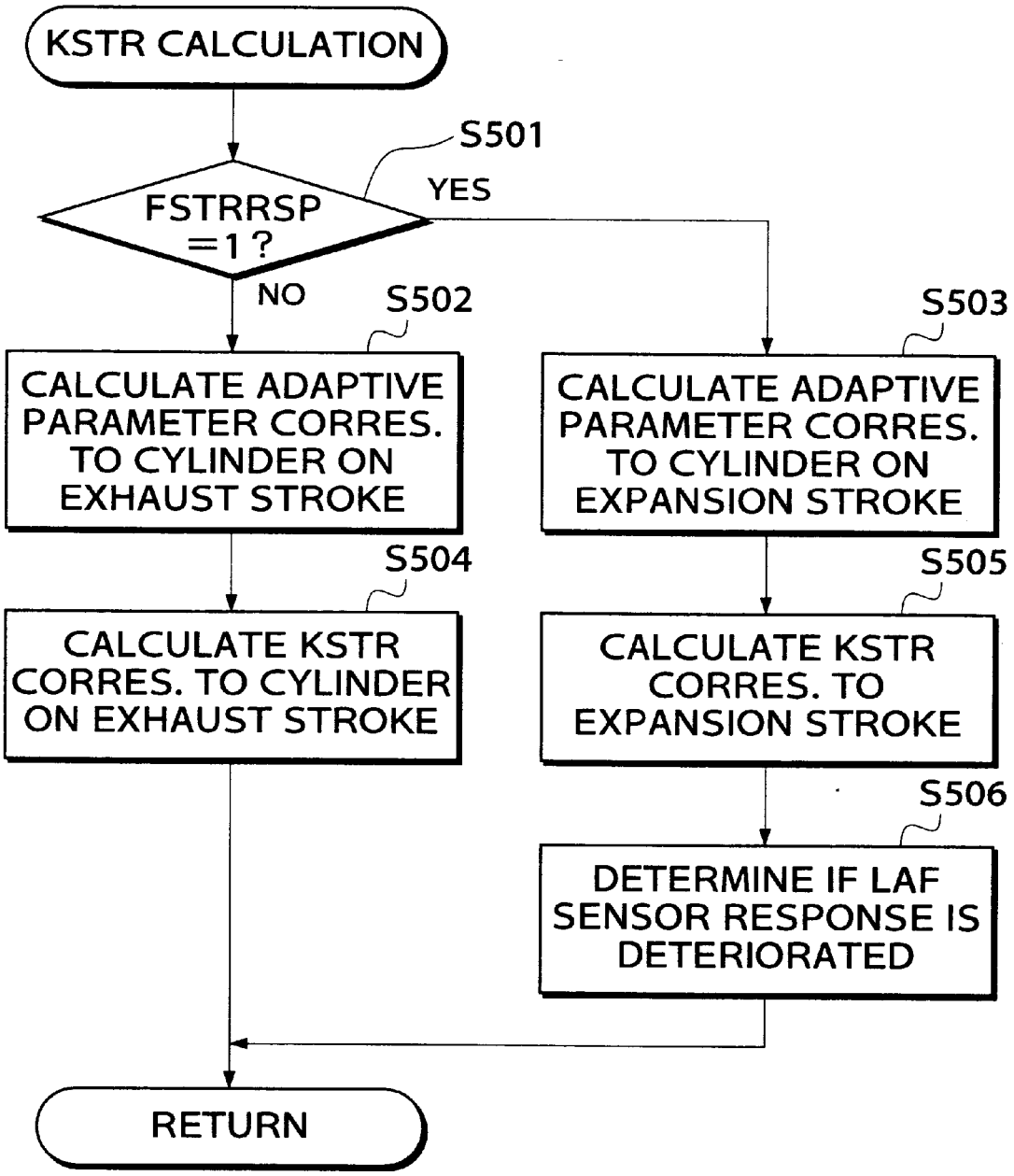
FIG. 26 is a flowchart showing a variation of FIG. 16 processing according to a fourth embodiment of the invention.

In FIG. 26, steps S501 and S506 correspond respectively to the steps S141 and S145 in FIG. 16. If it is determined at the step S501 that the flag FSTRRSP is 1, that is, the response characteristic of the LAF sensor is not deteriorated, a value of the adaptive parameter ($\hat{\theta}(k)$) corresponding to a cylinder on the expansion stroke (e.g. #1 cylinder provided that ignition occurs in the order of #1 cylinder, #3 cylinder, #4 cylinder, and #2 cylinder) is calculated at a step S503. Then, a value of the coefficient KSTR corresponding to the cylinder on the expansion stroke is calculated at a step S504, followed by terminating the program. On the other hand, if the flag FSTRRSP is 1, that is, the response characteristic of the LAF sensor is deteriorated, a value of the adaptive parameter $\hat{\theta}(k)$) corresponding to a cylinder (e.g. #3 cylinder) on the exhaust stroke is calculated at a step S503, and then a value of the coefficient KSTR corresponding to the cylinder on the exhaust stroke is calculated at a step S505, followed by determining the response deterioration of the LAF sensor and terminating the program.

According to the present embodiment, when deterioration of the response characteristic of the air-fuel ratio sensor is detected, the calculation timing of the feedback control amount based on the air-fuel ratio sensor is delayed. As a result, degradation of the controllability of the air-fuel ratio control responsive to the output from the air-fuel ratio sensor can be minimized, to thereby maintain good controllability of the air-fuel ratio control for a long time period.

A fifth embodiment of the invention will be now described. In the fifth embodiment, when response delay of the response characteristic of the LAF sensor is detected, in addition to the fail-safe action of the fourth embodiment, i.e. delaying the calculation timing of the adaptive control correction coefficient KSTR by the time interval of generation of adjacent TDC signal pulses, a further fail-safe action is carried out such that the number of cycles d=2 indicative of the ineffective time of the adaptive control shown in FIG. 15 is changed to the number of cycles d=3 (i.e. see FIG. 24 wherein there are three blocks $z^{-1}$). Except for this, the fifth embodiment is identical with the fourth embodiment.

Figure 24:
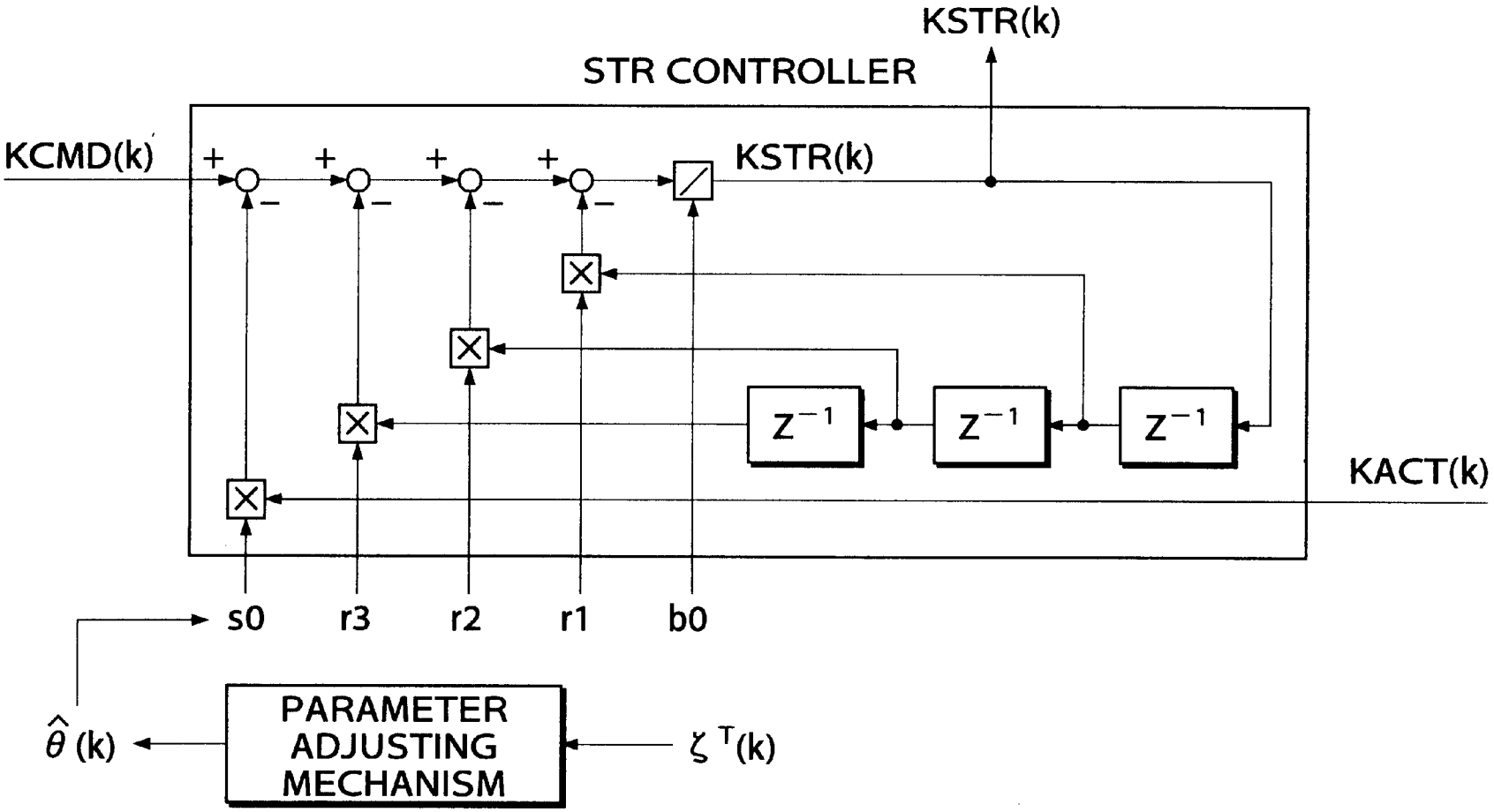
FIG. 24 is a block diagram useful in explaining a manner of calculating the adaptive control correction coefficient KSTR, according to a fifth embodiment of the invention.

More specifically, when deterioration of the response characteristic of the LAF sensor is detected, i.e. if FSTRRSP=0 holds, in place of the STR controller and the parameter adjusting mechanism shown in FIG. 15, the adaptive control correction coefficient KSTR is calculated by the use of an STR controller and a parameter adjusting mechanism shown in FIG. 24. In the present case, the adaptive parameter $\hat{\theta}(k)$ is expressed by the following equation (20) in place of the equation (11), and the input $\zeta(k)$ to the parameter adjusting mechanism is expressed by the following equation (21) in place of the equation (12). Further, the following equation (22) is employed for calculating the adaptive control correction coefficient KSTR in place of the equation (17):

$$\hat{\theta}^T(k) = [b_0(k), r_1(k), r_2(k), r_3(k), s_0(k)] \tag{20}$$

$$\zeta^T(k) = [u(k), u(k-1), u(k-2), u(k-3), y(k)] \tag{21}$$

$$KSTR(k) = \frac{KCMD(k-d') - s_0 \times KACT(k) - r_1 \times KSTR(k-1) - r_2 \times KSTR(k-2) - r_3 \times KSTR(k-3)}{b_0} \tag{22}$$

According to the present embodiment, when deterioration of the response characteristic of the air-fuel ratio sensor is detected, in addition to delaying the calculation timing of the feedback control amount, the construction of the feedback control means is changed according to the resulting increase in the ineffective time indicative of the responsiveness of the air-fuel ratio control. As a result, excellent adaptive control can be achieved even if the response characteristic of the LAF sensor is deteriorated.

A sixth embodiment of the invention will now be described, which inhibits execution of the adaptive control when deterioration of the response characteristic of the LAF sensor is detected, in place of changing the gain matrix Γ as in the first and second embodiments. In other words, when deterioration of the response characteristic of the LAF sensor is detected, only the PID control is executed for the air-fuel ratio feedback control. Except for this, the sixth embodiment is identical with the first and second embodiments.

Figure 25:
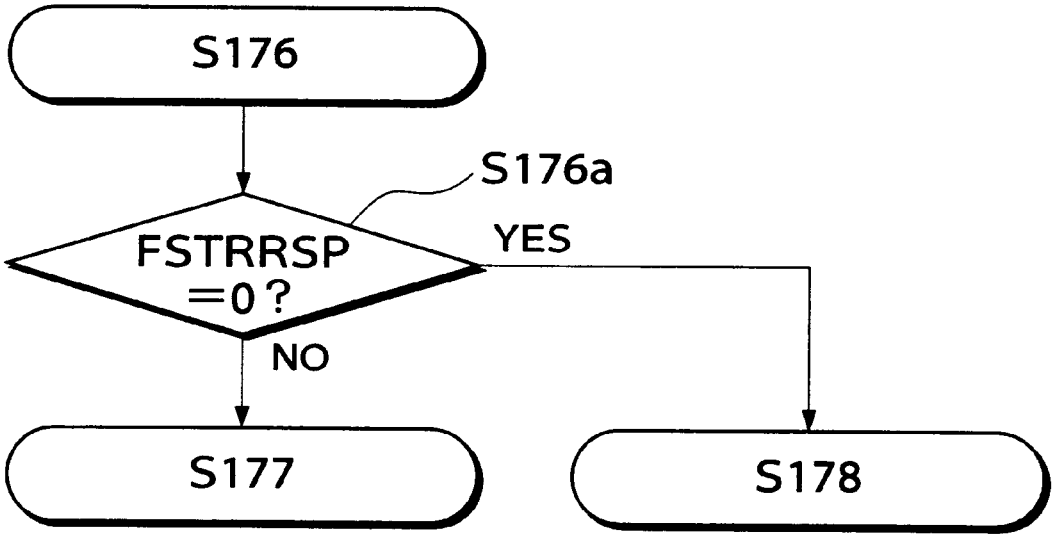
FIG. 25 is part of a flowchart showing a variation of the FIG. 19 processing, according to a sixth embodiment of the invention.

More specifically, in the present embodiment, a subroutine shown in FIG. 25 is executed for determining the STR region, which is similar to the subroutine of FIG. 19 except that a step S176a is added between the steps S176 and S178. That is, if FSTRRSP=0 holds, which means that deterioration of the response characteristic of the LAF sensor is detected, the program proceeds to the step S178. On the other hand, if FSTRRSP=1 holds, which means that the deterioration of the response characteristic is not detected, the program proceeds to the step S177.

According to the present embodiment, when deterioration of the response characteristic of the LAF sensor is detected, feedback control using the adaptive controller of a recurrence formula type is inhibited, to thereby prevent the air-fuel ratio control from becoming unstable.

What is claimed is:

1. An air-fuel ratio control system for an internal combustion engine having an exhaust system, comprising:

an air-fuel ratio sensor arranged in said exhaust system;

feedback control means for carrying out feedback control of an amount of fuel to be supplied to said engine by calculating a feedback control amount, based on an output from said air-fuel ratio sensor and in synchronism with a predetermined crank angle position of the engine by using an adaptive controller of a recurrence formula type, and controlling said amount of fuel to be supplied to said engine, based on the calculated feedback control amount, such that an air-fuel ratio of an air-fuel mixture supplied to said engine is converged to a desired air-fuel ratio;

response characteristic deterioration-detecting means for detecting deterioration of a response characteristic of said air-fuel ratio sensor; and delaying means responsive to detection of said deterioration of said response characteristic of said air-fuel ratio sensor by said response characteristic deterioration-detecting means, for delaying timing of said calculation of said feedback control amount by said feedback control means to a timing corresponding to said predetermined crank angle position of the engine.

2. An air-fuel ratio control system as claimed in claim 1, wherein said adaptive controller includes adaptive control means for calculating an adaptive control correction coefficient (KSTR), based on a plurality of adaptive parameters $\hat{\theta}(k)$) by using a recurrence formula, such that said air-fuel ratio of said air-fuel mixture supplied to said engine becomes equal to said desired air-fuel ratio, said delaying means delaying said timing of said calculation of said adaptive control correction coefficient.

3. An air-fuel ratio control system as claimed in claim 1, further including construction-changing means responsive to detection of said deterioration of said response characteristic of said air-fuel ratio sensor by said response characteristic deterioration-detecting means, for changing a construction of said feedback control means according to an increase in an ineffective time representative of responsiveness of said air-fuel ratio control system caused by said deterioration of said response characteristic of said air-fuel ratio sensor detected by said response characteristic deterioration-detecting means.

4. An air-fuel ratio control system as claimed in claim 3, wherein said adaptive controller includes adaptive control means for setting said adaptive control correction coefficient (KSTR), based on said plurality of said adaptive parameters $\hat{\theta}(k)$) by using a recurrence formula, said recurrence formula having a factor (d) representative of a number of control cycles of said feedback control means, said factor (d) corresponding to said ineffective time, such that said air-fuel ratio of said air-fuel mixture supplied to said engine becomes equal to said desired air-fuel ratio, said construction-changing means setting said factor (d) of said recurrence formula to a larger value.

5. An air-fuel ratio control system as claimed in claim 2, wherein said response characteristic deterioration-detecting means detects said deterioration of said response characteristic of said air-fuel ratio sensor, based on at least one adaptive parameter (r1, r2) used by said adaptive controller.

6. An air-fuel ratio control system as claimed in claim 1, wherein said response characteristic deterioration-detecting means detects said deterioration of said response characteristic of said air-fuel ratio sensor, based on a change characteristic of said output from said air-fuel ratio sensor assumed immediately after interruption of supply of fuel to said engine.

* * * * *